US009466275B2

(12) United States Patent
Biswas et al.

(10) Patent No.: US 9,466,275 B2
(45) Date of Patent: Oct. 11, 2016

(54) COMPLEXITY SCALABLE PERCEPTUAL TEMPO ESTIMATION

(75) Inventors: Arijit Biswas, Nuremberg (DE); Danilo Hollosi, Döbeln (DE); Michael Schug, Erlangen (DE)

(73) Assignee: Dolby International AB, Amsterdam (NL)

( * ) Notice: Subject to any disclaimer, the term of this patent is extended or adjusted under 35 U.S.C. 154(b) by 841 days.

(21) Appl. No.: 13/503,136

(22) PCT Filed: Oct. 26, 2010

(86) PCT No.: PCT/EP2010/066151

§ 371 (c)(1),
(2), (4) Date: Apr. 20, 2012

(87) PCT Pub. No.: WO2011/051279

PCT Pub. Date: May 5, 2011

(65) Prior Publication Data

US 2012/0215546 A1 Aug. 23, 2012

Related U.S. Application Data

(60) Provisional application No. 61/256,528, filed on Oct. 30, 2009.

(51) Int. Cl.
*G10H 7/00* (2006.01)
*G10H 1/40* (2006.01)

(52) U.S. Cl.
CPC ..... *G10H 1/40* (2013.01); *G10H 2210/076* (2013.01); *G10H 2230/015* (2013.01); *G10H 2240/075* (2013.01)

(58) Field of Classification Search
CPC ..... G10H 1/40; G10H 2210/076; G10H 2230/015; G10H 2240/075
USPC ..... 84/612
See application file for complete search history.

(56) References Cited

U.S. PATENT DOCUMENTS 6,826,525 B2 11/2004 Hilpert
6,978,236 B1 12/2005 Liljeryd
(Continued)

FOREIGN PATENT DOCUMENTS

CN 101145032 3/2008
CN 101375327 2/2009
(Continued)

OTHER PUBLICATIONS

Lee, Chang-Hsing, et al. "Automatic Music Genre Classification Using Modulation Spectral Contrast Feature" IEEE International Conference on Multimedia and Expo, Jul. 2-5, 2007, pp. 204-207.
(Continued)

*Primary Examiner* — Jianchun Qin

(57) ABSTRACT

The present document relates to methods and systems for estimating the tempo of a media signal, such as audio or combined video/audio signal. In particular, the document relates to the estimation of tempo perceived by human listeners, as well as to methods and systems for tempo estimation at scalable computational complexity. A method and system for extracting tempo information of an audio signal from an encoded bit-stream of the audio signal comprising spectral band replication data is described. The method comprises the steps of determining a payload quantity associated with the amount of spectral band replication data comprised in the encoded bit-stream for a time interval of the audio signal; repeating the determining step for successive time intervals of the encoded bit-stream of the audio signal, thereby determining a sequence of payload quantities; identifying a periodicity in the sequence of payload quantities; and extracting tempo information of the audio signal from the identified periodicity.

8 Claims, 12 Drawing Sheets

(56) References Cited

U.S. PATENT DOCUMENTS

| | | | | |
|---|---|---|---|---|
| 7,013,269 | B1 | 3/2006 | Bhaskar | |
| 7,050,980 | B2 | 5/2006 | Wang | |
| 7,069,208 | B2 | 6/2006 | Wang | |
| 7,328,162 | B2 | 2/2008 | Ekstrand | |
| 7,447,639 | B2 | 11/2008 | Wang | |
| 7,518,053 | B1 | 4/2009 | Jochelson | |
| 2003/0065517 | A1 | 4/2003 | Miyashita | |
| 2004/0083110 | A1 | 4/2004 | Wang | |
| 2009/0070120 | A1 | 3/2009 | Suzuki | |
| 2010/0262427 | A1* | 10/2010 | Chivukula et al. | 704/500 |

FOREIGN PATENT DOCUMENTS

| | | |
|---|---|---|
| JP | 2007-272118 | 10/2007 |
| JP | 2008-70650 | 3/2008 |
| TW | 454172 | 9/2001 |
| TW | 200641796 | 12/2006 |
| TW | 200818124 | 4/2008 |
| TW | I302664 | 11/2008 |
| TW | 200921642 | 5/2009 |
| WO | 2006037366 | 4/2006 |
| WO | 2006050512 | 5/2006 |
| WO | 2008033433 | 3/2008 |
| WO | 2009/125489 | 10/2009 |

OTHER PUBLICATIONS

Zhu, J., et al., "Comlexity-Scalable Beat Detection with MP3 Audio Bistreams" COmputer Music Journal, 2008, pp. 71-87.

Wang, Y., et al., "A Compressed Domain Beat Detector Using MP3 Audio Bistreams" Proc of ACM Multimedia 2001, pp. 194-202.

Den Brinker, A.C., et al., "An Overview of the Coding Standard MPEG-4 Audio Amendments 1 and 2: HE-AAC, SSC, and HE-AAC v2" EURASIP Journal on Audio, Speech and Music vol. 2009, Jan. 2009, Article No. 3.

Ekstrand, Per, "Bandwidth Extension of Audio Signals by Spectral Band Replication" Proc 1st IEEE Benelux Workshop on Model Based Processing and Coding of Audio, Leuven, Belgium, Nov. 15, 2002.

Friedrich, T., et al., "A Fast Feature Extraction System on Compressed Audio Data" AES Convention Paper, presented at the 124th Convention May 17-20, 2008, Amsterdam, The Netherlands.

Friedrich, T., et al., "Subband Conversion for Feature Extraction from Compressed Audio" IEEE ICASSP 2008, pp. 217-220.

Ravelli, E., et al., "Fast MIR in a Sparse Transform Domain" ISMIR 2008 Session 4c Automatic Music Analysis and Transcription, pp. 527-532.

Shi, Y. Y., et al., "A Tempo Feature via Modulation Spectrum Analysis and its Application to Music Emotion Classification" IEEE, ICME 2006, pp. 1085-1088.

Wang, Y., et al., "Parametric Vector Quantization for Coding Percussive Sounds in Music" IEEE, ICASSP 2003, pp. v-652-v-655.

Wang, Ye, "Selected Advances in Audio Compression and Compressed Domain Processing" AES 111th Convention, New York, USA Sep. 21-24, 2001.

Zhu, J., et al., "Pop Music Beat Detection in the Huffman Coded Domain" 2008.

* cited by examiner

COMPLEXITY SCALABLE PERCEPTUAL TEMPO ESTIMATION

TECHNICAL FIELD

The present document relates to methods and systems for estimating the tempo of a media signal, such as an audio or combined video/audio signal. In particular, the document relates to the estimation of tempo perceived by human listeners, as well as to methods and systems for tempo estimation at scalable computational complexity.

BACKGROUND OF THE INVENTION

Portable handheld devices, e.g. PDAs, smart phones, mobile phones, and portable media players, typically comprise audio and/or video rendering capabilities and have become important entertainment platforms. This development is pushed forward by the growing penetration of wireless or wireline transmission capabilities into such devices. Due to the support of media transmission and/or storage protocols, such as the HE-AAC format, media content can be continuously downloaded and stored onto the portable handheld devices, thereby providing a virtually unlimited amount of media content.

However, low complexity algorithms are crucial for mobile/handheld devices, since limited computational power and energy consumption are critical constraints. These constraints are even more critical for low-end portable devices in emerging markets. In view of the high amount of media files available on typical portable electronic devices, MIR (Music Information Retrieval) applications are desirable tools in order to cluster or classify the media files and thereby allow a user of the portable electronic device to identify an appropriate media file, e.g. an audio, music and/or video file. Low complexity calculation schemes for such MIR applications are desirable as otherwise their usability on portable electronic devices having limited computational and power resources would be compromised.

An important musical feature for various MIR applications like genre and mood classification, music summarization, audio thumbnailing, automatic playlist generation and music recommendation systems using music similarity etc. is musical tempo. Thus, a procedure for tempo determination having low computational complexity would contribute to the development of decentralized implementations of the mentioned MIR applications for mobile devices.

Furthermore, while it is common to characterize music tempo by a notated tempo on a sheet music or a musical score in BPM (Beats Per Minute), this value often does not correspond to the perceptual tempo. For instance, if a group of listeners (including skilled musicians) is asked to annotate the tempo of music excerpts, they typically give different answers, i.e. they typically tap at different metrical levels. For some excerpts of music the perceived tempo is less ambiguous and all the listeners typically tap at the same metrical level, but for other excerpts of music the tempo can be ambiguous and different listeners identify different tempos. In other words, perceptual experiments have shown that the perceived tempo may differ from the notated tempo. A piece of music can feel faster or slower than its notated tempo in that the dominant perceived pulse can be a metrical level higher or lower than the notated tempo. In view of the fact that MIR applications should preferably take into account the tempo most likely to be perceived by a user, an automatic tempo extractor should predict the most perceptually salient tempo of an audio signal.

Known tempo estimation methods and systems have various drawbacks. In many cases they are limited to particular audio codecs, e.g. MP3, and cannot be applied to audio tracks which are encoded with other codecs. Furthermore, such tempo estimation methods typically only work properly when applied on western popular music having simple and clear rhythmical structures. In addition, the known tempo estimation methods do not take into account perceptual aspects, i.e. they are not directed at estimating the tempo which is most likely perceived by a listener. Finally, known tempo estimation schemes typically work in only one of an uncompressed PCM domain, a transform domain or a compressed domain.

It is desirable to provide tempo estimation methods and systems which overcome the above mentioned shortcomings of known tempo estimation schemes. In particular, it is desirable to provide tempo estimation which is codec agnostic and/or applicable to any kind of musical genre. In addition, it is desirable to provide a tempo estimation scheme which estimates the perceptually most salient tempo of an audio signal. Furthermore, a tempo estimation scheme is desirable which is applicable to audio signals in any of the above mentioned domains, i.e. in the uncompressed PCM domain, the transform domain and the compressed domain. It is also desirable to provide tempo estimation schemes with low computational complexity.

The tempo estimation schemes may be used in various applications. Since tempo is the fundamental semantic information in music, a reliable estimate of such tempo will enhance the performance of other MIR applications, such as automatic content-based genre classification, mood classification, music similarity, audio thumbnailing and music summarization. Furthermore, a reliable estimate for perceptual tempo is a useful statistic for music selection, comparison, mixing, and playlisting. Notably, for an automatic playlist generator or a music navigator or a DJ apparatus, the perceptual tempo or feel is typically more relevant than the notated or physical tempo. In addition, a reliable estimate for perceptual tempo may be useful for gaming applications. By way of example, soundtrack tempo could be used to control the relevant game parameters, such as the speed of the game or vice-versa. This can be used for personalizing the game content using audio and for providing users with enhanced experience. A further application field could be content-based audio/video synchronization, where the musical beat or tempo is a primary information source used as the anchor for timing events.

It should be noted that in the present document the term "tempo" is understood to be the rate of the tactus pulse. This tactus is also referred to as the foot tapping rate, i.e. the rate at which listeners tap their feet when listening to the audio signal, e.g. the music signal. This is different from the musical meter defining the hierarchical structure of a music signal.

SUMMARY OF THE INVENTION

According to an aspect, a method for extracting tempo information of an audio signal from an encoded bit-stream of the audio signal, wherein the encoded bit-stream comprises spectral band replication data, is described. The encoded bit-stream may be an HE-AAC bit-stream or an mp3PRO bit-stream. The audio signal may comprise a music signal and extracting tempo information may comprise estimating a tempo of the music signal.

The method may comprise the step of determining a payload quantity associated with the amount of spectral band replication data comprised in the encoded bit-stream for a time interval of the audio signal. Notably, in case the encoded bit-stream is an HE-AAC bit-stream, the latter step may comprise determining the amount of data comprised in the one or more fill-element fields of the encoded bit-stream in the time interval and determining the payload quantity based on the amount of data comprised in the one or more fill-element fields of the encoded bit-stream in the time interval.

Due to the fact that spectral band replication data may be encoded using a fixed header, it may be beneficial to remove such header prior to extracting tempo information. In particular, the method may comprise the step of determining the amount of spectral band replication header data comprised in the one or more fill-element fields of the encoded bit-stream in the time interval. Furthermore, a net amount of data comprised in the one or more fill-element fields of the encoded bit-stream in the time interval may be determined by deducting or subtracting the amount of spectral band replication header data comprised in the one or more fill-element fields of the encoded bit-stream in the time interval. Consequently, the header bits have been removed, and the payload quantity may be determined based on the net amount of data. It should be noted that if the spectral band replication header is of fixed length, the method may comprise counting the number X of spectral band replication headers in a time interval and deducting or subtracting X times the length of the header from the amount of spectral band replication header data comprised in the one or more fill-element fields of the encoded bit-stream in the time interval.

In an embodiment, the payload quantity corresponds to the amount or the net amount of spectral band replication data comprised in the one or more fill-element fields of the encoded bit-stream in the time interval. Alternatively or in addition, further overhead data may be removed from the one or more fill-element fields in order to determine the actual spectral band replication data.

The encoded bit-stream may comprise a plurality of frames, each frame corresponding to an excerpt of the audio signal of a pre-determined length of time.

By way of example, a frame may comprise an excerpt of a few milliseconds of a music signal. The time interval may correspond to the length of time covered by a frame of the encoded bit-stream. By way of example, an AAC frame typically comprises 1024 spectral values, i.e. MDCT coefficients. The spectral values are a frequency representation of a particular time instance or time interval of the audio signal. The relationship between time and frequency can be expressed as follows: $f_S=2\cdot f_{MAX}$ and $$t=\frac{1}{f_s},$$

wherein $f_{MAX}$ is the covered frequency range, $f_S$, is the sampling frequency and t is the time resolution, i.e. the time interval of the audio signal covered by a frame. For a sampling frequency of $f_S$=44100 Hz, this corresponds to a time resolution $$t=\frac{1024}{44100\text{ Hz}}=23,219\text{ ms}$$

for an AAC frame. Since in an embodiment HE-AAC is defined to be a "dual-rate system" where its core encoder (AAC) works at half the sampling frequency, a maximum time resolution of $$t=\frac{1024}{22050\text{ Hz}}46,4399\text{ ms}$$

can be achieved.

The method may comprise the further step of repeating the above determining step for successive time intervals of the encoded bit-stream of the audio signal, thereby determining a sequence of payload quantities. If the encoded bit-stream comprises a succession of frames, then this repeating step may be performed for a certain set of frames of the encoded bit-stream, i.e. for all frames of the encoded bit-stream.

In a further step, the method may identify a periodicity in the sequence of payload quantities. This may be done by identifying a periodicity of peaks or recurring patterns in the sequence of payload quantities. The identification of periodicities may be done by performing spectral analysis on the sequence of payload quantities yielding a set of power values and corresponding frequencies. A periodicity may be identified in the sequence of payload quantities by determining a relative maximum in the set of power values and by selecting the periodicity as the corresponding frequency. In an embodiment, an absolute maximum is determined.

The spectral analysis is typically performed along the time axis of the sequence of payload quantities. Furthermore, the spectral analysis is typically performed on a plurality of sub-sequences of the sequence of payload quantities thereby yielding a plurality of sets of power values. By way of example, the sub-sequences may cover a certain length of the audio signal, e.g. 6 seconds. Furthermore, the sub-sequences may overlap each other, e.g. by 50%. As such, a plurality of sets of power values may be obtained, wherein each set of power values corresponds to a certain excerpt of the audio signal. An overall set of power values for the complete audio signal may be obtained by averaging the plurality of sets of power values. It should be understood that the term "averaging" covers various types of mathematical operations, such as calculating a mean value or determining a median value. I.e. an overall set of power values may be obtained by calculating the set of mean power values or the set of median power values of the plurality of sets of power values. In an embodiment, performing spectral analysis comprises performing a frequency transform, such as a Fourier Transform or a FFT.

The sets of power values may be submitted to further processing. In an embodiment, the set of power values is multiplied with weights associated with the human perceptual preference of their corresponding frequencies. By way of example, such perceptual weights may emphasize frequencies which correspond to tempi that are detected more frequently by a human, while frequencies which correspond to tempi that are detected less frequently by a human are attenuated.

The method may comprise the further step of extracting tempo information of the audio signal from the identified periodicity. This may comprise determining the frequency corresponding to the absolute maximum value of the set of power values. Such a frequency may be referred to as a physically salient tempo of the audio signal.

According to a further aspect, a method for estimating a perceptually salient tempo of an audio signal is described. A perceptually salient tempo may be the tempo that is perceived most frequently by a group of users when listening to the audio signal, e.g. a music signal. It is typically different from a physically salient tempo of an audio signal, which may be defined as the physically or acoustically most prominent tempo of the audio signal, e.g. the music signal.

The method may comprise the step of determining a modulation spectrum from the audio signal, wherein the modulation spectrum typically comprises a plurality of frequencies of occurrence and a corresponding plurality of importance values, wherein the importance values indicate the relative importance of the corresponding frequencies of occurrence in the audio signal. In other words, the frequencies of occurrence indicate certain periodicities in the audio signal, while the corresponding importance values indicate the significance of such periodicities in the audio signal. By way of example, a periodicity may be a transient in the audio signal, e.g. the sound of a base drum in a music signal, which occurs at recurrent time instants. If this transient is distinctive, then the importance value corresponding to its periodicity will typically be high.

In an embodiment, the audio signal is represented by a sequence of PCM samples along a time axis. For such cases, the step of determining a modulation spectrum may comprise the steps of selecting a plurality of succeeding, partially overlapping sub-sequences from the sequence of PCM samples; determining a plurality of succeeding power spectra having a spectral resolution for the plurality of succeeding sub-sequences; condensing the spectral resolution of the plurality of succeeding power spectra using Mel frequency transformation or any other perceptually motivated non-linear frequency transformation; and/or performing spectral analysis along the time axis on the plurality of succeeding condensed power spectra, thereby yielding the plurality of importance values and their corresponding frequencies of occurrence.

In an embodiment, the audio signal is represented by a sequence of succeeding subband coefficient blocks along a time axis. Such subband coefficients may e.g. be MDCT coefficients as in the case of the MP3, AAC, HE-AAC, Dolby Digital, and Dolby Digital Plus codecs. In such cases the step of determining a modulation spectrum may comprise condensing the number of subband coefficients in a block using a Mel frequency transformation; and/or performing spectral analysis along the time axis on the sequence of succeeding condensed subband coefficient blocks, thereby yielding the plurality of importance values and their corresponding frequencies of occurrence.

In an embodiment, the audio signal is represented by an encoded bit-stream comprising spectral band replication data and a plurality of succeeding frames along a time axis. By way of example, the encoded bit-stream may be an HE-AAC or an mp3PRO bit-stream. In such cases, the step of determining a modulation spectrum may comprise determining a sequence of payload quantities associated with the amount of spectral band replication data in the sequence of frames of the encoded bit-stream; selecting a plurality of succeeding, partially overlapping sub-sequences from the sequence of payload quantities; and/or performing spectral analysis along the time axis on the plurality of succeeding sub-sequences, thereby yielding the plurality of importance values and their corresponding frequencies of occurrence. In other words, the modulation spectrum may be determined according to the method outlined above.

Furthermore, the step of determining a modulation spectrum may comprise processing to enhance the modulation spectrum. Such processing may comprise multiplying the plurality of importance values with weights associated with the human perceptual preference of their corresponding frequencies of occurrence.

The method may comprise the further step of determining a physically salient tempo as the frequency of occurrence corresponding to a maximum value of the plurality of importance values. This maximum value may be the absolute maximum value of the plurality of importance values.

The method may comprise the further step of determining a beat metric of the audio signal from the modulation spectrum. In an embodiment, the beat metric indicates a relationship between the physically salient tempo and at least one other frequency of occurrence corresponding to a relatively high value of the plurality of importance values, e.g. the second highest value of the plurality of importance values. The beat metric may be one of: 3, e.g. in case of a 3/4 beat; or 2, e.g. in case of a 4/4 beat. The beat metric may be a factor associated with the ratio between the physically salient tempo and at least one other salient tempo, i.e. a frequency of occurrence corresponding to a relatively high value of the plurality of importance values, of the audio signal. In general terms, the beat metric may represent the relationship between a plurality of physically salient tempi of an audio signal, e.g. between the two physically most salient tempi of the audio signal.

In an embodiment, determining a beat metric comprises the steps of determining the autocorrelation of the modulation spectrum for a plurality of non-zero frequency lags; identifying a maximum of autocorrelation and a corresponding frequency lag; and/or determining the beat metric based on the corresponding frequency lag and the physically salient tempo. Determining a beat metric may also comprise the steps of determining the cross correlation between the modulation spectrum and a plurality of synthesized tapping functions corresponding to a plurality of beat metrics, respectively; and/or selecting the beat metric which yields maximum cross correlation.

The method may comprise the step of determining a perceptual tempo indicator from the modulation spectrum. A first perceptual tempo indicator may be determined as a mean value of the plurality of importance values, normalized by a maximum value of the plurality of importance values. A second perceptual tempo indicator may be determined as the maximum importance value of the plurality of importance values. A third perceptual tempo indicator may be determined as the centroid frequency of occurrence of the modulation spectrum.

The method may comprise the step of determining the perceptually salient tempo by modifying the physically salient tempo in accordance with the beat metric, wherein the modifying step takes into account a relation between the perceptual tempo indicator and the physically salient tempo. In an embodiment, the step of determining the perceptually salient tempo comprises determining if the first perceptual tempo indicator exceeds a first threshold; and modifying the physically salient tempo only if the first threshold is exceeded. In an embodiment, the step of determining the perceptually salient tempo comprises determining if the second perceptual tempo indicator is below a second threshold; and modifying the physically salient tempo if the second perceptual tempo indicator is below the second threshold.

Alternatively or in addition, the step of determining the perceptually salient tempo may comprise determining a mismatch between the third perceptual tempo indicator and the physically salient tempo; and if a mismatch is determined, modifying the physically salient tempo. A mismatch may be determined e.g. by determining that the third perceptual tempo indicator is below a third threshold and the physically salient tempo is above a fourth threshold; and/or by determining that the third perceptual tempo indicator is above a fifth threshold and the physically salient tempo is below a sixth threshold. Typically, at least one of the third, fourth, fifth and sixth thresholds is associated with human perceptual tempo preferences. Such perceptual tempo preferences may indicate a correlation between the third perceptual tempo indicator and the subjective perception of speed of an audio signal perceived by a group of users.

The step of modifying the physically salient tempo in accordance with the beat metric may comprise increasing a beat level to the next higher beat level of the underlying beat; and/or decreasing the beat level to the next lower beat level of the underlying beat. By way of example, if the underlying beat is a 4/4 beat, increasing the beat level may comprise increasing the physically salient tempo, e.g. the tempo corresponding to the quarter notes, by a factor 2, thereby yielding the next higher tempo, e.g. the tempo corresponding to the eighth notes. In a similar manner, decreasing the beat level may comprise dividing by 2, thereby shifting from a 1/8 based tempo to a 1/4 based tempo.

In an embodiment, increasing or decreasing the beat level may comprise multiplying or dividing the physically salient tempo by 3 in case of a 3/4 beat; and/or multiplying or dividing the physically salient tempo by 2 in case of a 4/4 beat.

According to a further aspect, a software program is described, which is adapted for execution on a processor and for performing the method steps outlined in the present document when carried out on a computing device.

According to another aspect, a storage medium is described, which comprises a software program adapted for execution on a processor and for performing the method steps outlined in the present document when carried out on a computing device.

According to another aspect, a computer program product is described which comprises executable instructions for performing the method outlined in the present document when executed on a computer.

According to a further aspect, a portable electronic device is described. The device may comprise a storage unit configured to store an audio signal; an audio rendering unit configured to render the audio signal; a user interface configured to receive a request of a user for tempo information on the audio signal; and/or a processor configured to determine the tempo information by performing the method steps outlined in the present document on the audio signal.

According to another aspect, a system configured to extract tempo information of an audio signal from an encoded bit-stream comprising spectral band replication data of the audio signal, e.g. an HE-AAC bit-stream, is described. The system may comprise means for determining a payload quantity associated with the amount of spectral band replication data comprised in the encoded bit-stream of a time interval of the audio signal; means for repeating the determining step for successive time intervals of the encoded bit-stream of the audio signal, thereby determining a sequence of payload quantities; means for identifying a periodicity in the sequence of payload quantities; and/or means for extracting tempo information of the audio signal from the identified periodicity.

According to a further aspect, a system configured to estimate a perceptually salient tempo of an audio signal is described. The system may comprise means for determining a modulation spectrum of the audio signal, wherein the modulation spectrum comprises a plurality of frequencies of occurrence and a corresponding plurality of importance values, wherein the importance values indicate the relative importance of the corresponding frequencies of occurrence in the audio signal; means for determining a physically salient tempo as the frequency of occurrence corresponding to a maximum value of the plurality of importance values; means for determining a beat metric of the audio signal by analyzing the modulation spectrum; means for determining a perceptual tempo indicator from the modulation spectrum; and/or means for determining the perceptually salient tempo by modifying the physically salient tempo in accordance with the beat metric, wherein the modifying step takes into account a relation between the perceptual tempo indicator and the physically salient tempo.

According to another aspect, a method for generating an encoded bit-stream comprising metadata of an audio signal is described. The method may comprise the step of encoding the audio signal into a sequence of payload data, thereby yielding the encoded bit-stream. By way of example, the audio signal may be encoded into an HE-AAC, MP3, AAC, Dolby Digital or Dolby Digital Plus bit-stream. Alternatively or in addition, the method may rely on an already encoded bit-stream, e.g. the method may comprise the step of receiving an encoded bit-stream.

The method may comprise the steps of determining metadata associated with a tempo of the audio signal and inserting the metadata into the encoded bit-stream. The metadata may be data representing a physically salient tempo and/or a perceptually salient tempo of the audio signal. The metadata may also be data representing a modulation spectrum from the audio signal, wherein the modulation spectrum comprises a plurality of frequencies of occurrence and a corresponding plurality of importance values, wherein the importance values indicate the relative importance of the corresponding frequencies of occurrence in the audio signal. It should be noted that the metadata associated with a tempo of the audio signal may be determined according to any of the methods outlined in the present document. I.e. the tempi and the modulation spectra may be determined according to the methods outlined in this document.

According to a further aspect, an encoded bit-stream of an audio signal comprising metadata is described. The encoded bit-stream may be an HE-AAC, MP3, AAC, Dolby Digital or Dolby Digital Plus bit-stream. The metadata may comprise data representing at least one of: a physically salient tempo and/or a perceptually salient tempo of the audio signal; or a modulation spectrum from the audio signal, wherein the modulation spectrum comprises a plurality of frequencies of occurrence and a corresponding plurality of importance values, wherein the importance values indicate the relative importance of the corresponding frequencies of occurrence in the audio signal. In particular, the metadata may comprise data representing the tempo data and the modulation spectral data generated by the methods outlined in the present document.

According to another aspect, an audio encoder configured to generate an encoded bit-stream comprising metadata of an audio signal is described. The encoder may comprise means for encoding the audio signal into a sequence of payload data, thereby yielding the encoded bit-stream; means for determining metadata associated with a tempo of the audio signal; and means for inserting the metadata into the encoded bit-stream. In a similar manner to the method outlined above, the encoder may rely on an already encoded bit-stream and the encoder may comprise means for receiving an encoded bit-stream.

It should be noted that according to a further aspect, a corresponding method for decoding an encoded bit-stream of an audio signal and a corresponding decoder configured to decode an encoded bit-stream of an audio signal is described. The method and the decoder are configured to extract the respective metadata, notably the metadata associated with tempo information, from the encoded bit-stream.

It should be noted that the embodiments and aspects described in this document may be arbitrarily combined. In particular, it should be noted that the aspects and features outlined in the context of a system are also applicable in the context of the corresponding method and vice versa. Furthermore, it should be noted that the disclosure of the present document also covers other claim combinations than the claim combinations which are explicitly given by the back references in the dependent claims, i.e., the claims and their technical features can be combined in any order and any formation.

BRIEF DESCRIPTION OF THE DRAWINGS

The present invention will now be described by way of illustrative examples, not limiting the scope or spirit of the invention, with reference to the accompanying drawings, in which.

DETAILED DESCRIPTION

Figure 1:
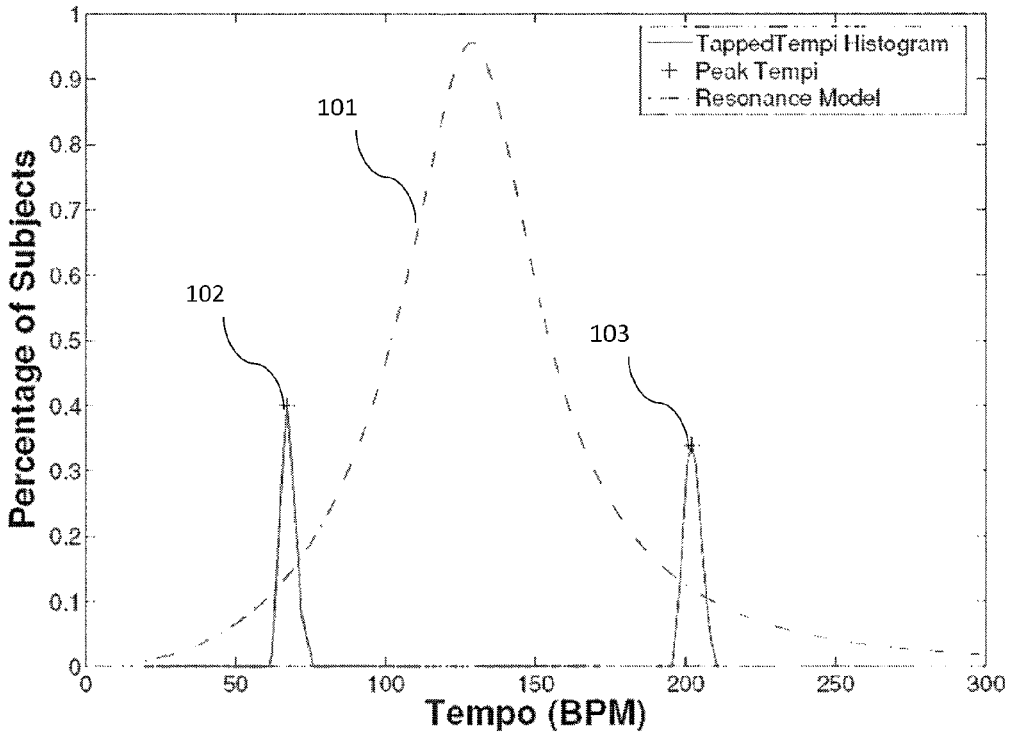
FIG. 1 illustrates an exemplary resonance model for large music collections vs. tapped tempi of a single musical excerpt.

The below-described embodiments are merely illustrative for the principles of methods and systems for tempo estimation. It is understood that modifications and variations of the arrangements and the details described herein will be apparent to others skilled in the art. It is the intent, therefore, to be limited only by the scope of the impending patent claims and not by the specific details presented by way of description and explanation of the embodiments herein.

As indicated in the introductory section, known tempo estimation schemes are restricted to certain domains of signal representation, e.g. the PCM domain, the transform domain or the compressed domain. In particular, there is no existing solution for tempo estimation where features are computed directly from the compressed HE-AAC bit-stream without performing entropy decoding. Furthermore, the existing systems are restricted to mainly western popular music.

Furthermore, existing schemes do not take into account the tempo perceived by human listeners, and as a result there are octave errors or double/half-time confusion. The confusion may arise from the fact that in music different instruments are playing at rhythms with periodicities which are integrally related multiples of each other. As will be outlined in the following, it is an insight of the inventors that the perception of tempo not only depends on the repetition rate or periodicities, but is also influenced by other perceptual factors, so that these confusions are overcome by making use of additional perceptual features. Based on these additional perceptual features, a correction of extracted tempi in a perceptually motivated way is performed, i.e. the above mentioned tempo confusion is reduced or removed.

As already highlighted, when talking about "tempo", it is necessary to distinguish between notated tempo, physically measured tempo and perceptual tempo. Physically measured tempo is obtained from actual measurements on the sampled audio signal, while perceptual tempo has a subjective character and is typically determined from perceptual listening experiments. Additionally, tempo is a highly content dependent musical feature and sometimes very difficult to detect automatically because in certain audio or music tracks the tempo carrying part of the musical excerpt is not clear. Also the listeners' musical experience and their focus have significant influence on the tempo estimation results. This might lead to differences within the tempo metric used when comparing notated, physically measured and perceived tempo. Still, physical and perceptual tempo estimation approaches may be used in combination in order to correct each other. This can be seen when e.g. full and double notes, which correspond to a certain beats per minute (BPM) value and its multiple, have been detected by a physical measurement on the audio signal, but the perceptual tempo is ranked as slow. Consequently, the correct tempo is the slower one detected, assuming that the physical measurement is reliable. In other words, an estimation scheme focussing on the estimation of the notated tempo will provide ambiguous estimation results corresponding to the full and the double notes. If combined with perceptual tempo estimation methods, the correct (perceptual) tempo can be determined.

Large scale experiments on human tempo perception show that the people tend to perceive musical tempo in the range between 100 and 140 BPM with a peak at 120 BPM. This can be modelled with the dashed resonance curve 101 shown in FIG. 1. This model can be used to predict the tempo distribution for large datasets. However, when comparing the results of tapping experiments for a single music file or track, see reference signs 102 and 103, with the resonance curve 101, it can be seen that perceived tempi 102, 103 of an individual audio track do not necessarily fit to the model 101. As can be seen, subjects may tap at different metrical levels 102 or 103 which sometimes results in a curve totally different from the model 101. This is especially true for different kinds of genres and different kinds of rhythms. Such metrical ambiguity results in a high degree of confusion for tempo determination and is a possible explanation to the overall "not satisfying" performance of non-perceptually driven tempo estimation algorithms.

In order to overcome this confusion, a new perceptually motivated tempo correction scheme is suggested, where weights are assigned to the different metrical levels based on the extraction of a number of acoustic cues, i.e. musical parameters or features. These weights can be used to correct extracted, physically calculated tempi. In particular, such a correction may be used to determine perceptually salient tempi.

In the following, methods for extracting tempo information from the PCM domain and the transform domain are described. Modulation spectral analysis may be used for this purpose. In general, modulation spectral analysis may be used to capture the repetitiveness of musical features over time. It can be used to evaluate long term statistics of a musical track and/or it can be used for quantitative tempo estimation. Modulation Spectra based on Mel Power spectra may be determined for the audio track in the uncompressed PCM (Pulse Code Modulation) domain and/or for the audio track in the transform domain, e.g. the HE-AAC (High Efficiency Advanced Audio Coding) transform domain.

For a signal represented in the PCM domain, the modulation spectrum is directly determined from the PCM samples of the audio signal. On the other hand, for audio signals represented in the transform domain, e.g. the HE-AAC transform domain, subband coefficients of the signal may be used for the determination of the modulation spectrum. For the HE-AAC transform domain, the modulation spectrum may be determined on a frame by frame basis of a certain number, e.g. 1024, of MDCT (Modified Discrete Cosine Transform) coefficients that have been directly taken from the HE-AAC decoder while decoding or while encoding.

When working in the HE-AAC transform domain, it may be beneficial to take into account the presence of short and long blocks. While short blocks may be skipped or dropped for the calculation of MFCC (Mel-frequency cepstral coefficients) or for the calculation of a cepstum computed on a non-linear frequency scale because of their lower frequency resolution, short blocks should be taken into consideration when determining the tempo of an audio signal. This is particularly relevant for audio and speech signals which contain numerous sharp onsets and consequently a high number of short blocks for high quality representation.

It is proposed that for a single frame, when comprising eight short blocks, interleaving of MDCT coefficients to a long block is performed. Typically, two types of blocks, long and short blocks, may be distinguished. In an embodiment, a long block equals the size of a frame (i.e. 1024 spectral coefficients which corresponds to a particular time resolution). A short block comprises 128 spectral values to achieve eight times higher time resolution (1024/128) for proper representation of the audio signals characteristics in time and to avoid pre-echo-artifacts. Consequently, a frame is formed by eight short blocks on the cost of reduced frequency resolution by the same factor eight. This scheme is usually referred to as the "AAC Block-Switching Scheme".

Figure 2:
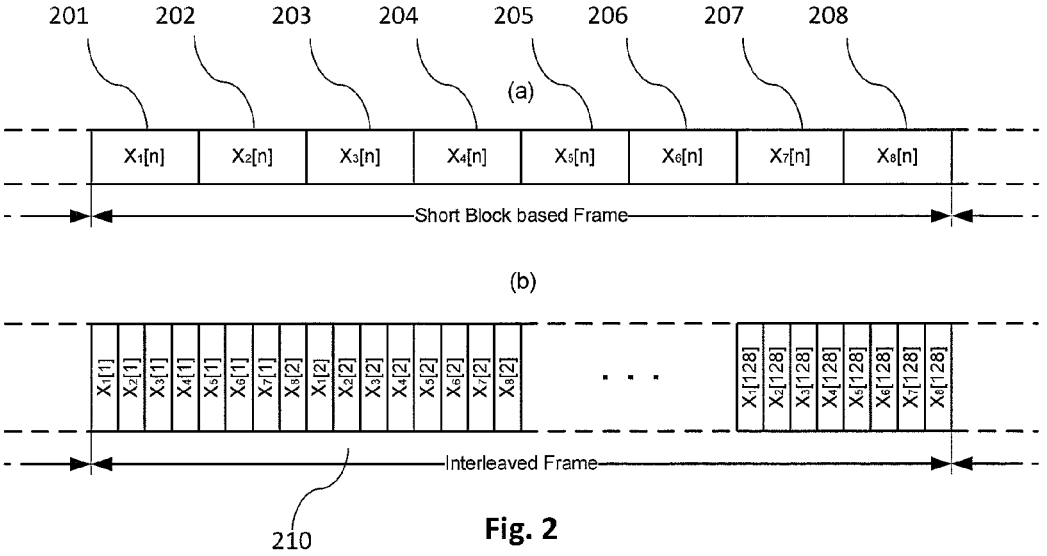
FIG. 2 shows an exemplary interleaving of MDCT coefficients for short blocks.

This is shown in FIG. 2, where the MDCT coefficients of the 8 short blocks 201 to 208 are interleaved such that respective coefficients of the 8 short blocks are regrouped, i.e. such that the first MDCT coefficients of the 8 blocks 201 to 208 are regrouped, followed by the second MDCT coefficients of the 8 blocks 201 to 208, and so on. By doing this, corresponding MDCT coefficients, i.e. MDCT coefficients which correspond to the same frequency, are grouped together. The interleaving of short blocks within a frame may be understood as an operation to "artificially" increase the frequency resolution within a frame. It should be noted that other means of increasing the frequency resolution may be contemplated.

In the illustrated example, a block 210 comprising 1024 MDCT coefficients is obtained for a suite of 8 short blocks. Due to the fact that the long blocks also comprise 1024 MDCT coefficients, a complete sequence of blocks comprising 1024 MDCT coefficients is obtained for the audio signal. I.e. by forming long blocks 210 from eight successive short blocks 201 to 208, a sequence of long blocks is obtained.

Figures 6A, 6B, 6C, 6D, 6E, 6F:
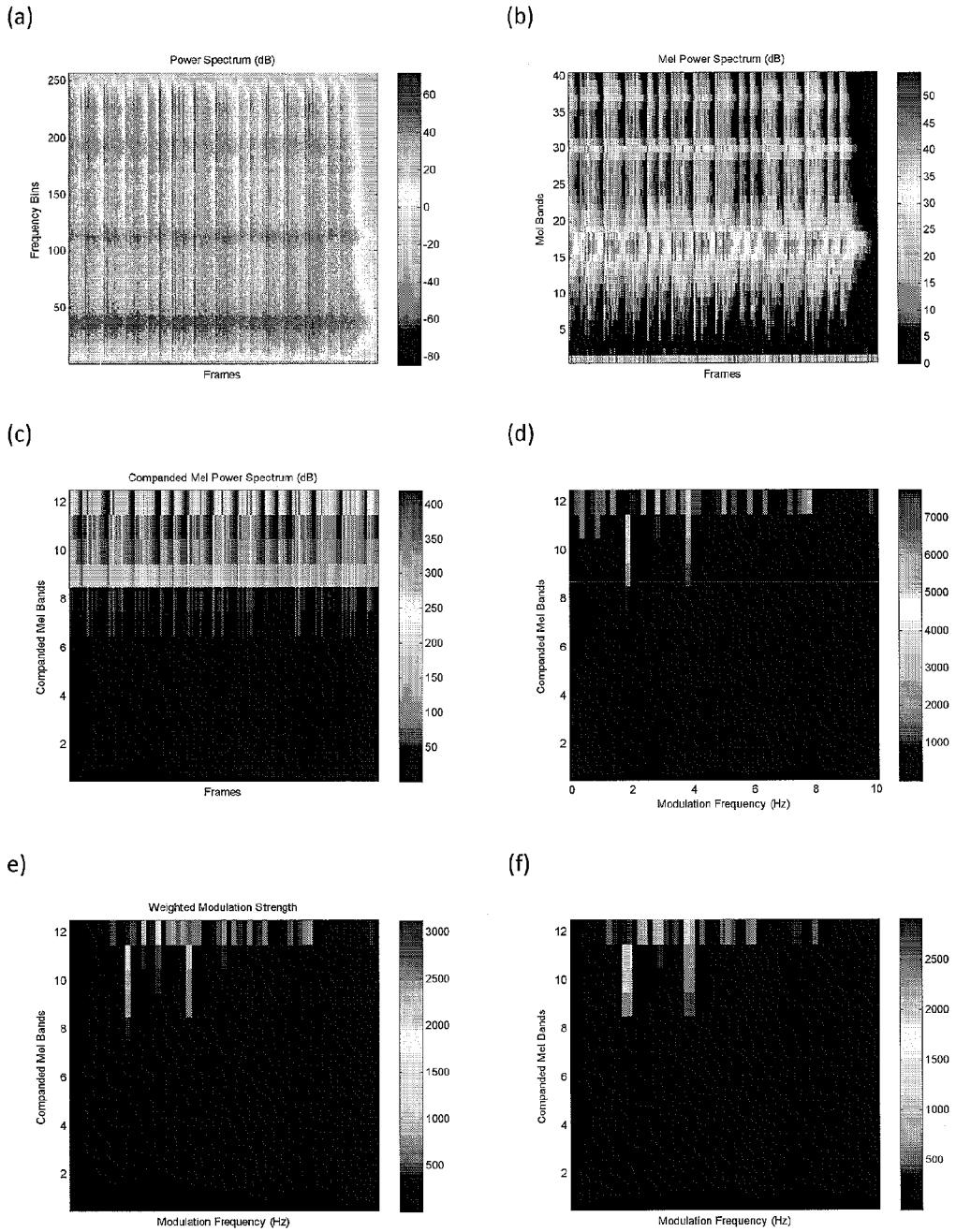
FIG. 6 illustrates exemplary power and modulation spectra.

Based on the block 210 of interleaved MDCT coefficients (in case of short blocks) and based on the block of MDCT coefficient for long blocks, a power spectrum is calculated for every block of MDCT coefficients. An exemplary power spectrum is illustrated in FIG. 6*a*.

It should be noted that, in general, the human auditory perception is a (typically non-linear) function of loudness and frequency, whereas not all frequencies are perceived with equal loudness. On the other hand, MDCT coefficients are represented on a linear scale both for amplitude/energy and frequency, which is contrary to the human auditory system which is non-linear for both cases. In order to obtain a signal representation that is closer to the human perception, transformations from linear to non-linear scales may be used. In an embodiment, the power spectrum transformation for MDCT coefficients on a logarithmic scale in dB is used to model the human loudness perception. Such power spectrum transformation may be calculated as follows:

$$\mathrm{MDCT}_{dB}[i]=10\log_{10}(\mathrm{MDCT}[i]^2).$$

Similarly, a power spectrogram or power spectrum may be calculated for an audio signal in the uncompressed PCM domain. For this purpose a STFT (Short Term Fourier Transform) of a certain length along time is applied to the audio signal. Subsequently, a power transformation is performed. In order to model the human loudness perception, a transformation on a non-linear scale, e.g. the above transformation on a logarithmic scale, may be performed. The size of the STFT may be chosen such that the resulting time resolution equals the time resolution of the transformed HE-AAC frames. However, the size of the STFT may also be set to larger or smaller values, depending of the desired accuracy and computational complexity.

Figure 3A:
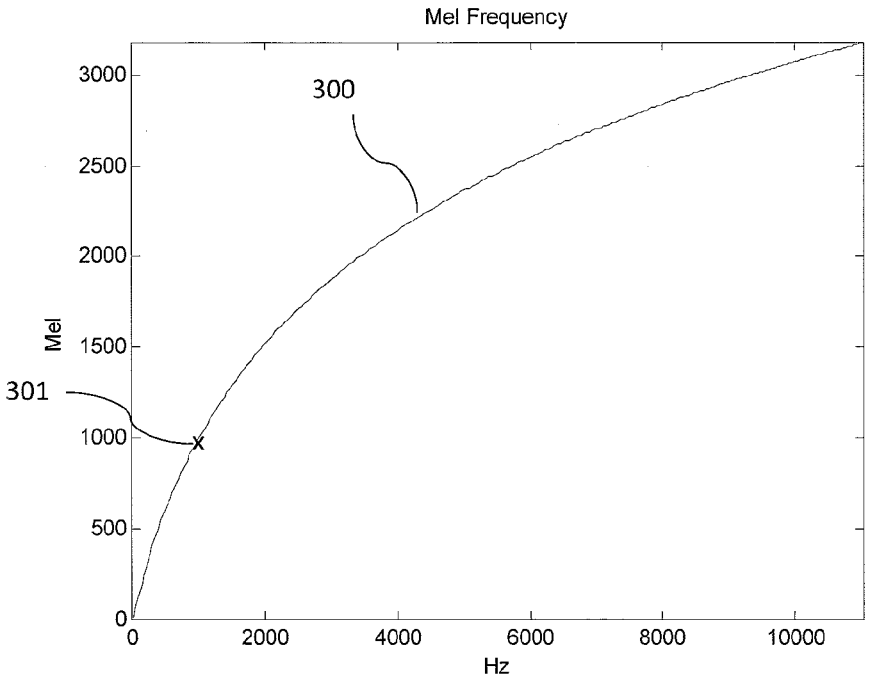
FIG. 3 shows an exemplary Mel scale and an exemplary Mel scale filter bank.
Figure 3B:
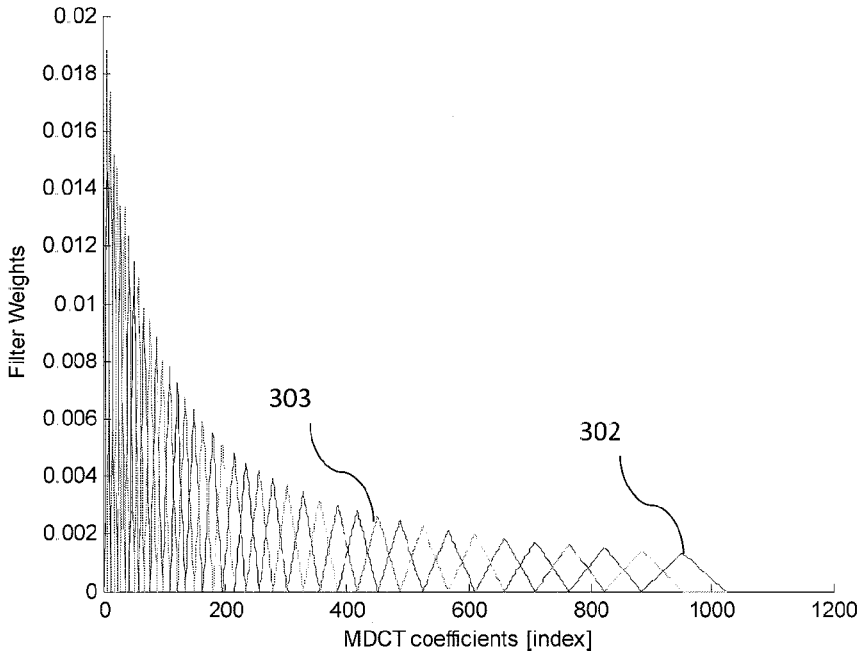

In a next step, filtering with a Mel filter-bank may be applied to model the non-linearity of human frequency sensitivity. For this purpose a non-linear frequency scale (Mel scale) as shown in FIG. 3*a* is applied. The scale 300 is approximately linear for low frequencies (<500 Hz) and logarithmic for higher frequencies. The reference point 301 to the linear frequency scale is a 1000 Hz tone which is defined as 1000 Mel. A tone with a pitch perceived twice as high is defined as 2000 Mel, and a tone with a pitch perceived half as high as 500 Mel, and so on. In mathematical terms, the Mel scale is given by:

$$m_{Mel}=1127.01048\ \ln(1+f_{Hz}/700)$$

wherein $f_{Hz}$ is the frequency in Hz and $m_{Mel}$ is the frequency in Mel. The Mel-scale transformation may be done to model the human non-linear frequency perception and furthermore, weights may be assigned to the frequencies in order to model the human non-linear frequency sensitivity. This may be done by using 50% overlapping triangular filters on a Mel-frequency scale (or any other non-linear perceptually motivated frequency scale), wherein the filter weight of a filter is the reciprocal of the bandwidth of the filter (non-linear sensitivity). This is shown in FIG. 3*b* which illustrates an exemplary Mel scale filter bank. It can be seen that filter 302 has a larger bandwidth than filter 303. Consequently, the filter weight of filter 302 is smaller than the filter weight of filter 303.

By doing this, a Mel power spectrum is obtained that represents the audible frequency range only with a few coefficients. An exemplary Mel power spectrum is shown in FIG. 6*b*. As a result of the Mel-scale filtering, the power spectrum is smoothed, specifically details in the higher frequencies are lost. In an exemplary case, the frequency axis of the Mel power spectrum may be represented by only 40 coefficients instead of 1024 MDCT coefficients per frame for the HE-AAC transform domain and a potentially higher number of spectral coefficients for the uncompressed PCM domain.

Figure 4:
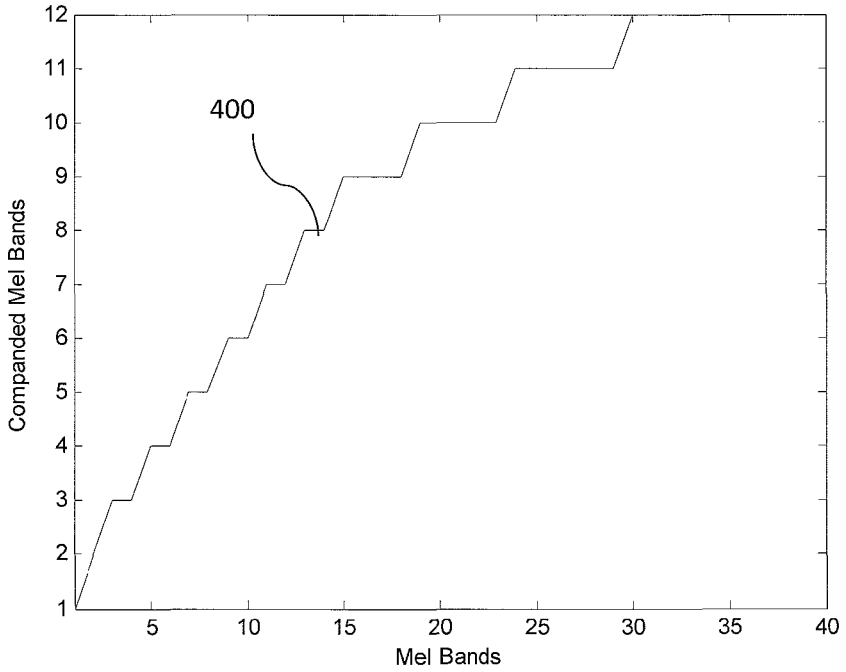
FIG. 4 illustrates an exemplary companding function.

To further reduce the number of data along frequency to a meaningful minimum, a companding function (CP) may be introduced which maps higher Mel-bands to single coefficients. The rationale behind this is that typically most of the information and signal power is located in lower frequency areas. An experimentally evaluated companding function is shown in Table 1 and a corresponding curve 400 is shown in FIG. 4. In an exemplary case, this companding function reduces the number of Mel power coefficients down to 12. An exemplary companded Mel power spectrum is shown in FIG. 6*c*.

TABLE 1

| Companded Mel band index | Mel band index (sum of (. . .)) |
|---|---|
| 1 | 1 |
| 2 | 2 |
| 3 | 3-4 |
| 4 | 5-6 |
| 5 | 7-8 |
| 6 | 9-10 |
| 7 | 11-12 |
| 8 | 13-14 |
| 9 | 15-18 |
| 10 | 19-23 |
| 11 | 24-29 |
| 12 | 30-40 |

It should be noted that the companding function may be weighted in order to emphasize different frequency ranges. In an embodiment, the weighting may ensure that the companded frequency bands reflect the average power of the Mel frequency bands comprised in a particular companded frequency band. This is different from the non-weighted companding function where the companded frequency bands reflect the total power of the Mel frequency bands comprised in a particular companded frequency band. By way of example, the weighting may take into account the number of Mel frequency bands covered by a companded frequency band. In an embodiment, the weighting may be inversely proportional to the number of Mel frequency bands comprised in a particular companded frequency band.

In order to determine the modulation spectrum, the companded Mel power spectrum, or any other of the previously determined power spectra, may be segmented into blocks representing a predetermined length of audio signal length. Furthermore, it may be beneficial to define a partial overlap of the blocks. In an embodiment, blocks corresponding to six seconds length of the audio signal with a 50% overlap over the time axis are selected. The length of the blocks may be chosen as a tradeoff between the ability to cover the long-time characteristics of the audio signal and computational complexity. An exemplary modulation spectrum determined from a companded Mel power spectrum is shown in FIG. 6*d*. As a side note, it should be mentioned that the approach of determining modulation spectra is not limited to Mel-filtered spectral data, but can be also used to obtain long term statistics of basically any musical feature or spectral representation.

For each such segment or block, a FFT is calculated along the time and frequency axis to obtain the amplitude modulated frequencies of the loudness. Typically, modulation frequencies in the range of 0-10 Hz are considered in the context of tempo estimation, as modulation frequencies beyond this range are typically irrelevant. As an outcome of the FFT analysis, which is determined for the power spectral data along the time or frame axis, the peaks of the power spectrum and the corresponding FFT frequency bins may be determined. The frequency or frequency bin of such a peak corresponds to the frequency of a power intensive event in an audio or music track, and thereby is an indication of the tempo of the audio or music track.

Figure 5:
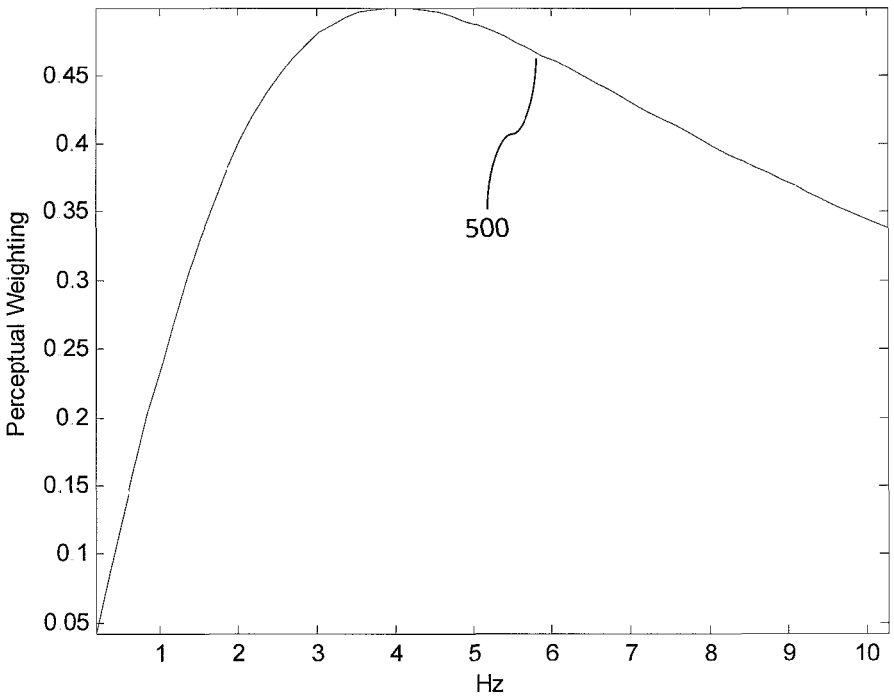
FIG. 5 illustrates an exemplary weighting function.

In order to improve the determination of relevant peaks of the companded Mel power spectrum, the data may be submitted to further processing, such as perceptual weighting and blurring. In view of the fact that human tempo preference varies with modulation frequency, and very high and very low modulation frequencies are unlikely to occur, a perceptual tempo weighting function may be introduced to emphasize those tempi with high likelihood of occurrence and suppress those tempi that are unlikely to occur. An experimentally evaluated weighting function 500 is shown in FIG. 5. This weighting function 500 may be applied to every companded Mel power spectrum band along the modulation frequency axis of each segment or block of the audio signal. I.e. the power values of each companded Mel-band may be multiplied by the weighting function 500. An exemplary weighted modulation spectrum is shown in FIG. 6*e*. It should be noted that the weighting filter or weighting function could be adapted if the genre of the music is known. For example, if it is known that electronic music is analyzed, the weighting function could have a peak around 2 Hz and be restrictive outside a rather narrow range. In other words, the weighting functions may depend on the music genre.

In order to further emphasize signal variations and to pronounce rhythmic content of the modulation spectra, absolute difference calculation along the modulation frequency axis may be performed. As a result the peak lines in the modulation spectrum may be enhanced. An exemplary differentiated modulation spectrum is shown in FIG. 6*f*.

Figures 6G, 6H:
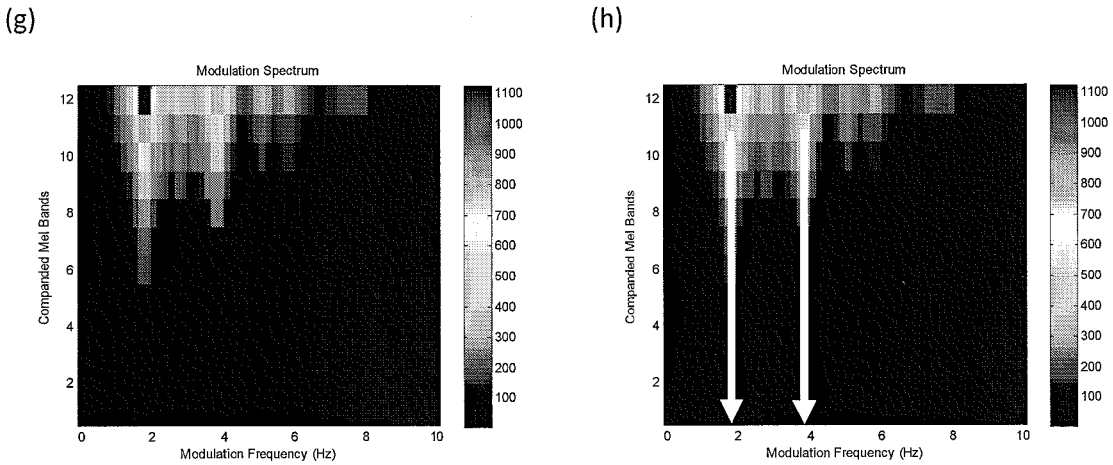

Additionally, perceptual blurring along the Mel-frequency bands or the Mel-frequency axis and the modulation frequency axis may be performed. Typically, this step smoothes the data in such a way that adjacent modulation frequency lines are combined to a broader, amplitude depending area. Furthermore, the blurring may reduce the influence of noisy patterns in the data and therefore lead to a better visual interpretability. In addition, the blurring may adapt the modulation spectrum to the shape of the tapping histograms obtained from individual music item tapping experiments (as shown in 102, 103 of FIG. 1). An exemplary blurred modulation spectrum is shown in FIG. 6*g*.

Finally, the joint frequency representation of a suite of segments or blocks of the audio signal may be averaged to obtain a very compact, audio file length independent Mel-frequency modulation spectrum. As already outlined above, the term "average" may refer to different mathematical operations including the calculation of mean values and the determination of a median. An exemplary averaged modulation spectrum is shown in FIG. 6*h*.

It should be noted that an advantage of such a modulation spectral representation of an audio track is that it is able to indicate tempi at multiple metrical levels. Furthermore, the modulation spectrum is able to indicate the relative physical salience of the multiple metrical levels in a format which is compatible with the tapping experiments used to determine the perceived tempo. In other words this representation matches well with the experimental "tapping" representation 102, 103 of FIG. 1 and it may therefore be the basis for perceptually motivated decisions on estimating the tempo of an audio track.

As already mentioned above, the frequencies corresponding to the peaks of the processed companded Mel power spectrum provide an indication of the tempo of the analyzed audio signal. Furthermore, it should be noted that the modulation spectral representation may be used to compare inter-song rhythmic similarity. In addition, the modulation spectral representation for the individual segments or blocks may be used to compare intra-song similarity for audio thumbnailing or segmentation applications.

Overall, a method has been described on how to obtain tempo information from audio signals in the transform domain, e.g. the HE-AAC transform domain, and the PCM domain. However, it may be desirable to extract tempo information from the audio signal directly from the compressed domain. In the following, a method is described on how to determine tempo estimates on audio signals which are represented in the compressed or bit-stream domain. A particular focus is made on HE-AAC encoded audio signals.

HE-AAC encoding makes use of High Frequency Reconstruction (HFR) or Spectral Band Replication (SBR) techniques. The SBR encoding process comprises a Transient Detection Stage, an adaptive T/F (Time/Frequency) Grid Selection for proper representation, an Envelope Estimation Stage and additional methods to correct a mismatch in signal characteristics between the low-frequency and the high-frequency part of the signal.

It has been observed that most of the payload produced by the SBR-encoder originates from the parametric representation of the envelope. Depending on the signal characteristics the encoder determines a time-frequency resolution suitable for proper representation of the audio segment and for avoiding pre-echo-artifacts. Typically, a higher frequency resolution is selected for quasi-stationary segments in time, whereas for dynamic passages, a higher time resolution is selected.

Consequently, the choice of the time-frequency resolution has significant influence on the SBR bit-rate, due to the fact that longer time-segments can be encoded more efficiently than shorter time-segments. At the same time, for fast changing content, i.e. typically for audio content having a higher tempo, the number of envelopes and consequently the number of envelope coefficients to be transmitted for proper representation of the audio signal is higher than for slow changing content. In addition to the impact of the selected time resolution, this effect further influences the size of the SBR data. As a matter of fact, it has been observed that the sensitivity of the SBR data rate to tempo variations of the underlying audio signal is higher than the sensitivity of the size of the Huffman code length used in the context of mp3 codecs. Therefore, variations in the bit-rate of SBR data have been identified as valuable information which can be used to determine rhythmic components directly from the encoded bit-stream.

Figure 7:
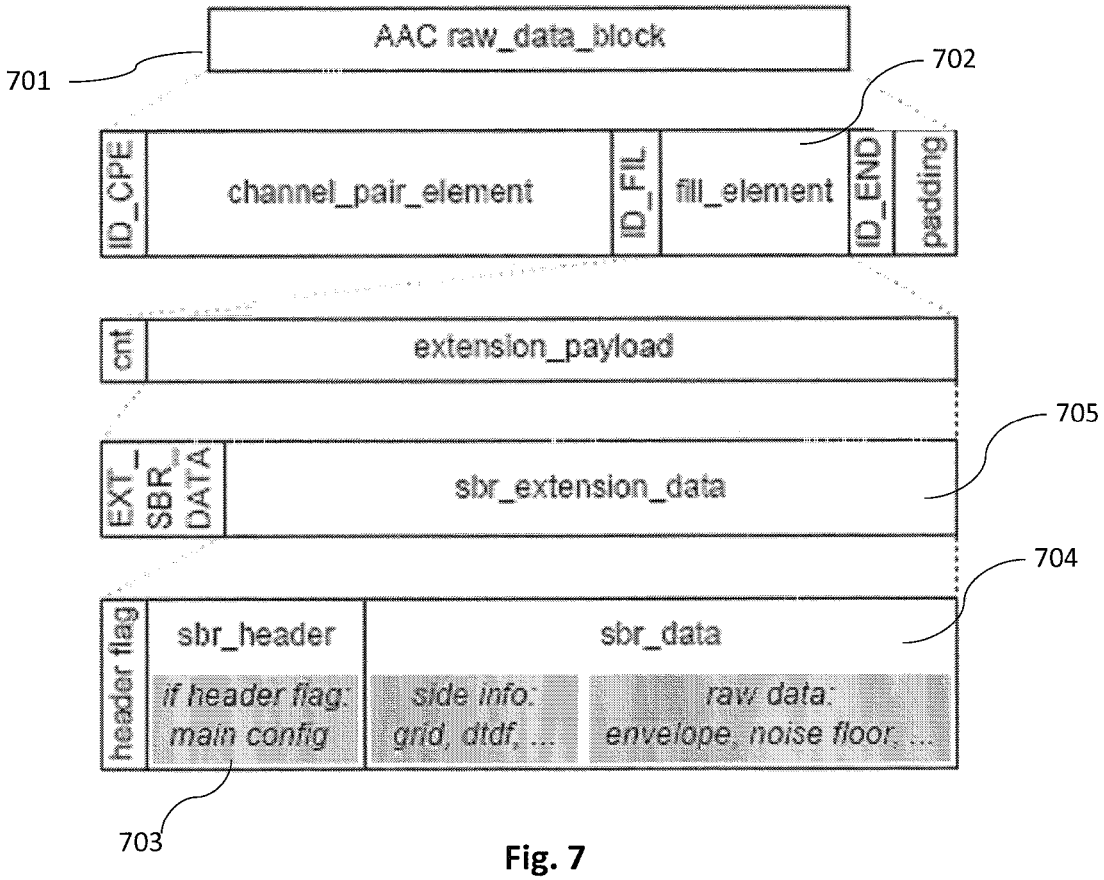
FIG. 7 shows an exemplary SBR data element.

FIG. 7 shows an exemplary AAC raw data block 701 which comprises a fill_element field 702. The fill_element field 702 in the bit-stream is used to store additional parametric side information such as SBR data. When using Parametric Stereo (PS) in addition to SBR (i.e., in HE-AAC v2), the fill_element field 702 also contains PS side information. The following explanations are based on the mono case. However, it should be noted that the described method also applies to bitstreams conveying any number of channels, e.g. the stereo case.

The size of the fill_element field 702 varies with the amount of parametric side information that is transmitted. Consequently, the size of the fill_element field 702 may be used to extract tempo information directly from the compressed HE-AAC stream. As shown in FIG. 7, the fill_element field 702 comprises an SBR header 703 and SBR payload data 704.

The SBR header 703 is of constant size for an individual audio file and is repeatedly transmitted as part of the fill_element field 702. This retransmission of the SBR header 703 results in a repeated peak in the payload data at a certain frequency, and consequently it results in a peak in the modulation frequency domain at 1/x Hz with a certain amplitude (x is the repetition rate for the transmission of the SBR header 703). However, this repeatedly transmitted SBR header 703 does not contain any rhythmic information and should therefore be removed.

This can be done by determining the length and the time-interval of occurrence of the SBR header 703 directly after bit-stream parsing. Due to the periodicity of the SBR header 703, this determination step typically only has to be done once. If the length and occurrence information is available, the total SBR data 705 can be easily corrected by subtracting the length of the SBR header 703 from the SBR data 705 at the time of occurrence of the SBR header 703, i.e. at the time of SBR header 703 transmission. This yields the size of the SBR payload 704 which can be used for tempo determination. It should be noted that in a similar manner the size of the fill_element field 702, corrected by subtracting the length of the SBR header 703, may be used for tempo determination, as it differs from the size of the SBR payload 704 only by a constant overhead.

Figure 8A:
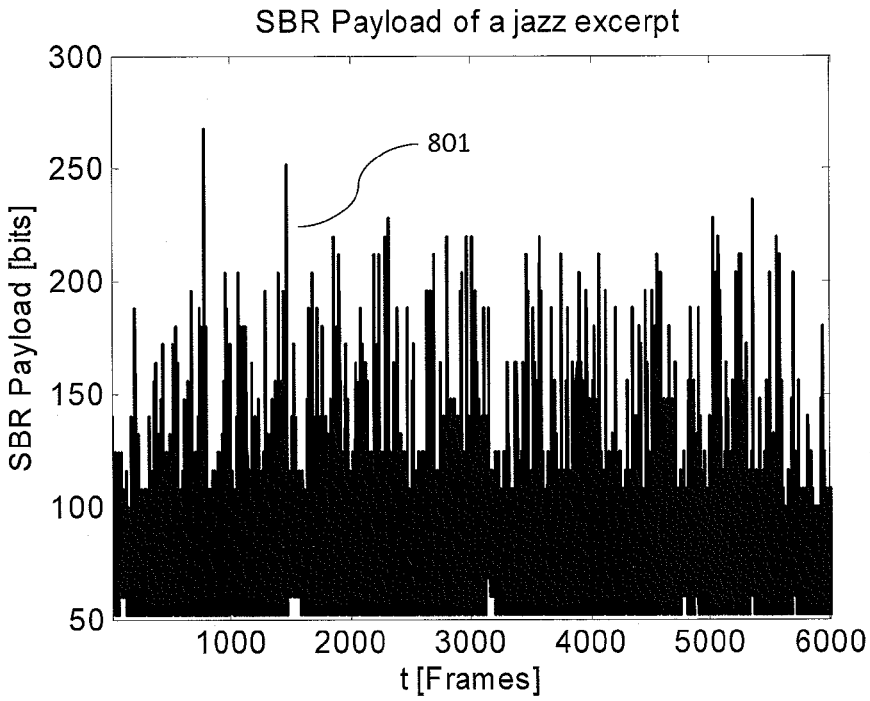
FIG. 8 illustrates an exemplary sequence of SBR payload size and resulting modulation spectra.

An example for a suite of SBR payload data 704 size or corrected fill_element field 702 size is given in FIG. 8*a*. The x-axis shows the frame number, whereas the y-axis indicates the size of the SBR payload data 704 or the size of the corrected fill_element field 702 for the corresponding frame. It can be seen that the size of the SBR payload data 704 varies from frame to frame. In the following, it is only referred to the SBR payload data 704 size. Tempo information may be extracted from the sequence 801 of the size of SBR payload data 704 by identifying periodicities in the size of SBR payload data 704. In particular, periodicities of peaks or repetitive patterns in the size of SBR payload data 704 may be identified. This can be done, e.g. by applying a FFT on overlapping sub-sequences of the size of SBR payload data 704. The sub-sequences may correspond to a certain signal length, e.g. 6 seconds. The overlapping of successive sub-sequences may be a 50% overlap. Subsequently, the FFT coefficients for the sub-sequences may be averaged across the length of the complete audio track. This yields averaged FFT coefficients for the complete audio track, which may be represented as a modulation spectrum 811 shown in FIG. 8*b*. It should be noted that other methods for identifying periodicities in the size of SBR payload data 704 may be contemplated.

Peaks 812, 813, 814 in the modulation spectrum 811 indicate repetitive, i.e. rhythmic patterns with a certain frequency of occurrence. The frequency of occurrence may also be referred to as the modulation frequency. It should be noted that the maximum possible modulation frequency is restricted by the time-resolution of the underlying core audio codec. Since HE-AAC is defined to be a dual-rate system with the AAC core codec working at half the sampling frequency, a maximum possible modulation frequency of around 21.74 Hz/2~11-Hz is obtained for a sequence of 6 seconds length (128 frames) and a sampling frequency $F_s$=44100 Hz. This maximum possible modulation frequency corresponds with approx. 660 BPM, which covers the tempo of almost every musical piece. For convenience while still ensuring correct processing, the maximum modulation frequency may be limited to 10 Hz, which corresponds to 600 BPM.

Figure 8B:
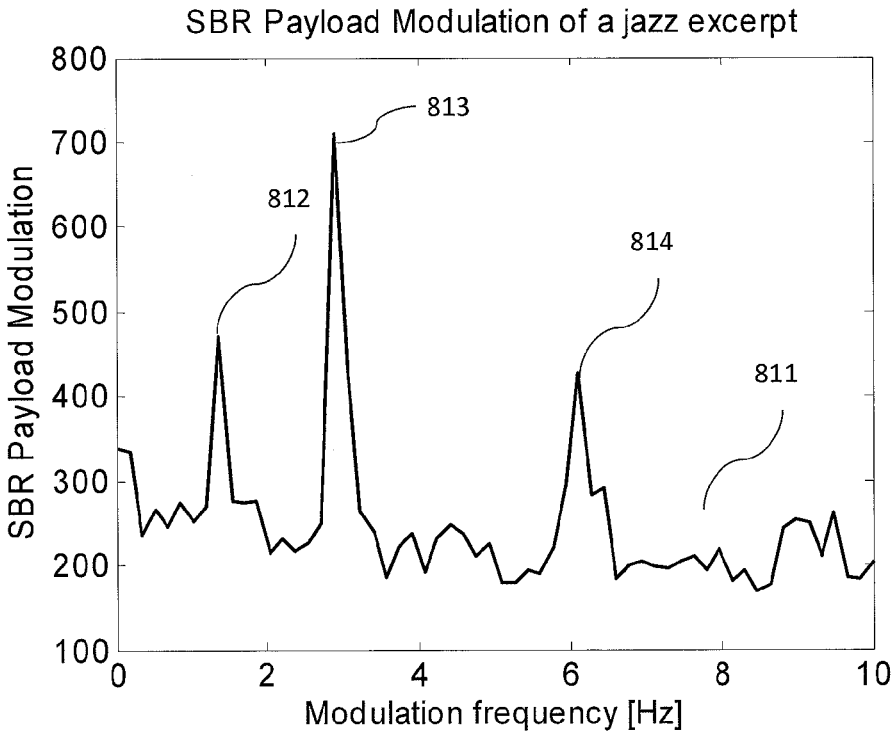
Figure 8C:
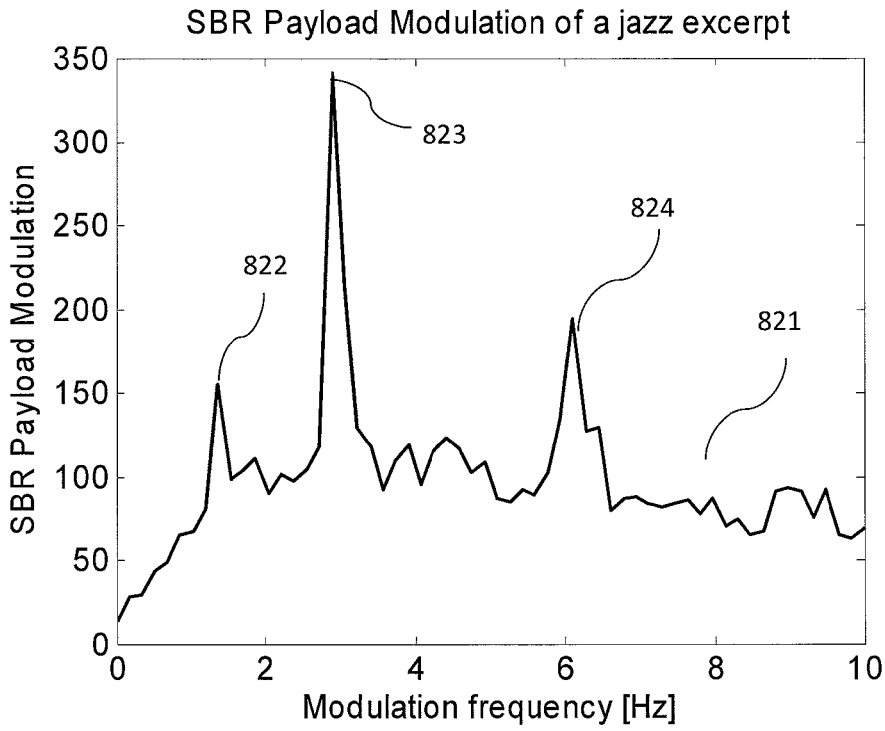

The modulation spectrum of FIG. 8*b* may be further enhanced in a similar manner as outlined in the context with the modulation spectra determined from the transform domain or the PCM domain representation of the audio signal. For instance, perceptual weighting using a weighting curve 500 shown in FIG. 5 may be applied to the SBR payload data modulation spectrum 811 in order to model the human tempo preferences. The resulting perceptually weighted SBR payload data modulation spectrum 821 is shown in FIG. 8*c*. It can be seen that very low and very high tempi are suppressed. In particular, it can be seen that the low frequency peak 822 and the high frequency peak 824 have been reduced compared to the initial peaks 812 and 814, respectively. On the other hand, the mid frequency peak 823 has been maintained.

By determining the maximum value of the modulation spectrum and its corresponding modulation frequency from the SBR payload data modulation spectrum, the physically most salient tempo can be obtained. In the case illustrated in FIG. 8*c*, the result is 178,659 BPM. However, in the present example, this physically most salient tempo does not correspond to the perceptually most salient tempo, which is around 89 BPM. By consequence, there is double confusion, i.e. confusion in the metric level, which needs to be corrected. For this purpose, a perceptual tempo correction scheme will be described below.

Figure 8D:
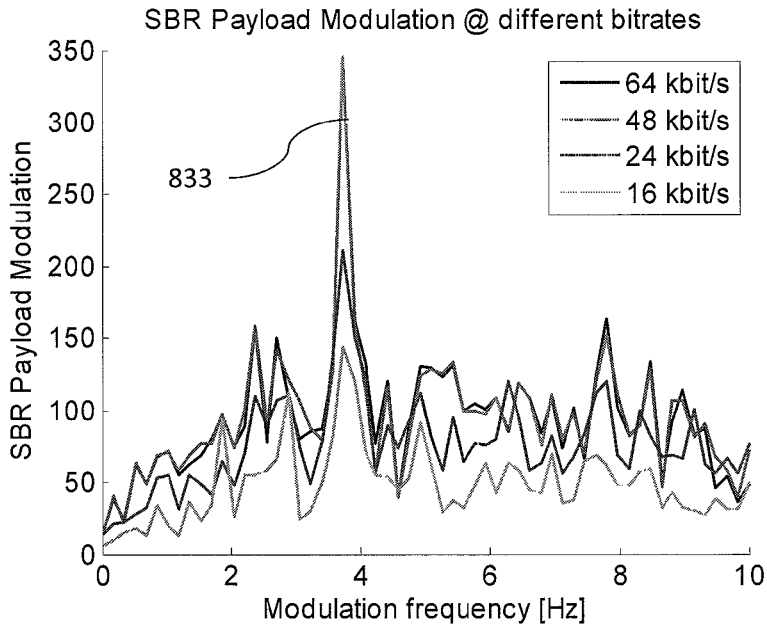

It should be noted that the proposed approach for tempo estimation based on SBR payload data is independent from the bit-rate of the musical input signal. When changing the bit-rate of an HE-AAC encoded bit-stream, the encoder automatically sets up the SBR start and stop frequency according to the highest output quality achievable at this particular bit-rate, i.e. the SBR cross-over frequency changes. Nevertheless, the SBR payload still comprises information with regards to repetitive transient components in the audio track. This can be seen in FIG. 8*d*, where SBR payload modulation spectra are shown for different bit-rates (16 kbit/s up to 64 kbit/s). It can be seen that repetitive parts (i.e., peaks in the modulation spectrum such as peak 833) of the audio signal stay dominant over all the bitrates. It may also be observed that fluctuations are present in the different modulation spectra because the encoder tries to save bits in the SBR part when decreasing the bit-rate.

Figure 9:
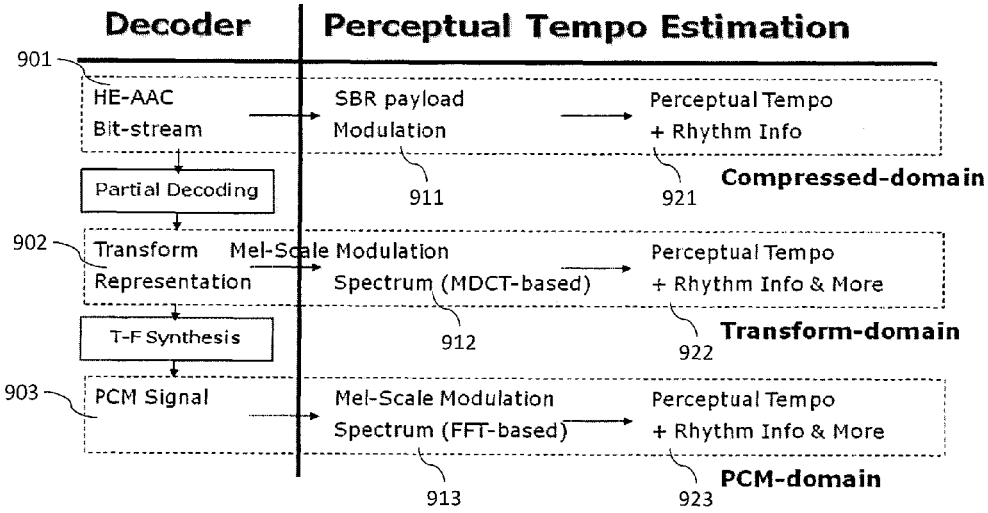
FIG. 9 shows an exemplary overview of the proposed tempo estimation schemes.

In order to summarize the above, reference is made to FIG. 9. Three different representations of an audio signal are considered. In the compressed domain, the audio signal is represented by its encoded bit-stream, e.g. by an HE-AAC bit-stream 901. In the transform domain, the audio signal is represented as subband or transform coefficients, e.g. as MDCT coefficients 902. In the PCM domain, the audio signal is represented by its PCM samples 903. In the above description, methods for determining a modulation spectrum in any of the three signal domains have been outlined. A method for determining a modulation spectrum 911 based on the SBR payload of an HE-AAC bit-stream 901 has been described. Furthermore, a method for determining a modulation spectrum 912 based on the transform representation 902, e.g. based on the MDCT coefficients, of the audio signal has been described. In addition, a method for determining a modulation spectrum 913 based on the PCM representation 903 of the audio signal has been described.

Any of the estimated modulation spectra 911, 912, 913 may be used as a basis for physical tempo estimation. For this purpose various steps of enhancement processing may be performed, e.g. perceptual weighting using a weighting curve 500, perceptual blurring and/or absolute difference calculation. Eventually, the maxima of the (enhanced) modulation spectra 911, 912, 913 and the corresponding modulation frequencies are determined. The absolute maximum of the modulation spectra 911, 912, 913 is an estimate for the physically most salient tempo of the analyzed audio signal. The other maxima typically correspond to other metrical levels of this physically most salient tempo.

Figure 10:
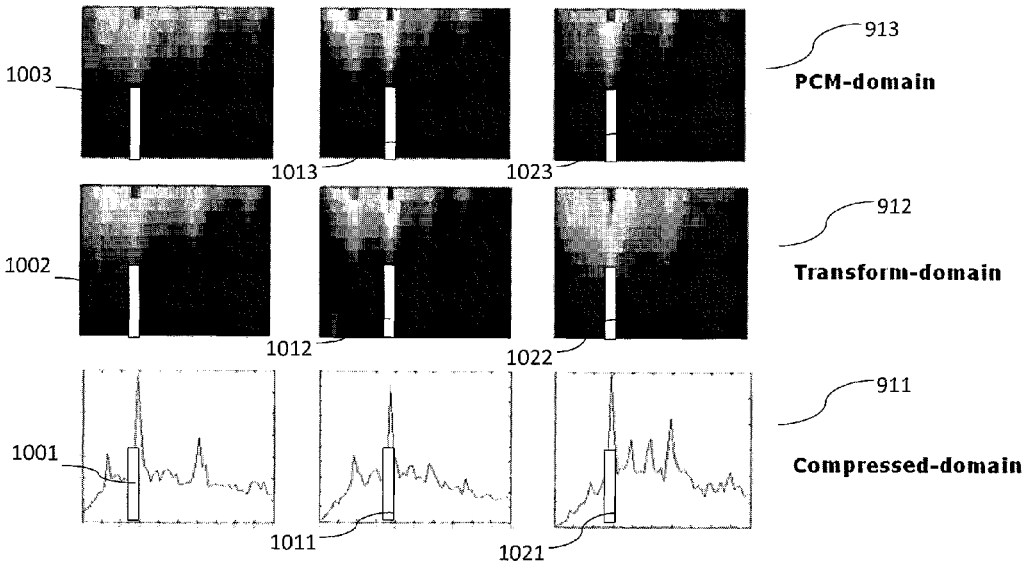
FIG. 10 shows an exemplary comparison of the proposed tempo estimation schemes.

FIG. 10 provides a comparison of the modulation spectra 911, 912, 913 obtained using the above mentioned methods. It can be seen that the frequencies corresponding to the absolute maxima of the respective modulation spectra are very similar. On the left side, an excerpt of an audio track of jazz music has been analyzed. The modulation spectra 911, 912, 913 have been determined from the HE-AAC representation, the MDCT representation and the PCM representation of the audio signal, respectively. It can be seen that all three modulation spectra provide similar modulation frequencies 1001, 1002, 1003 corresponding to the maximum peak of the modulation spectra 911, 912, 913, respectively. Similar results are obtained for an excerpt of classical music (middle) with modulation frequencies 1011, 1012, 1013 and an excerpt of metal hard rock music (right) with modulation frequencies 1021, 1022, 1023.

As such, methods and corresponding systems have been described which allow for the estimation of physically salient tempi by means of modulation spectra derived from different forms of signal representations. These methods are applicable to various types of music and are not restricted to western popular music only. Furthermore, the different methods are applicable to different forms of signal representation and may be performed at low computational complexity for each respective signal representation.

As can be seen in FIGS. 6, 8 and 10, the modulation spectra typically have a plurality of peaks which usually correspond to different metrical levels of the tempo of the audio signal. This can be seen e.g. in FIG. 8*b* where the three peaks 812, 813 and 814 have significant strength and might therefore be candidates for the underlying tempo of the audio signal. Selecting the maximum peak 813 provides the physically most salient tempo. As outlined above, this physically most salient tempo may not correspond to the perceptually most salient tempo. In order to estimate this perceptually most salient tempo in an automatic way, a perceptual tempo correction scheme is outlined in the following.

In an embodiment, the perceptual tempo correction scheme comprises the determination of a physically most salient tempo from the modulation spectrum. In case of the modulation spectrum 811 in FIG. 8*b*, the peak 813 and the corresponding modulation frequency would be determined. In addition, further parameters may be extracted from the modulation spectrum to assist the tempo correction. A first parameter may be $MMS_{Centroid}$ (Mel Modulation Spectrum), which is the centroid of the modulation spectrum according to equation 1. The centroid parameter $MMS_{Centroid}$ may be used as an indicator of the speed of an audio signal.

$$MMS_{Centroid} = \frac{\sum_{d=1}^{D} d \cdot \sum_{n=1}^{N} \overline{MMS}(n, d)}{\sum_{d=1}^{D} \sum_{n=1}^{N} \overline{MMS}(n, d)} \tag{1}$$

In the above equation, D is the number of modulation frequency bins and d=1, . . . , D identifies a respective modulation frequency bin. N is the total number of frequency bins along the Mel-frequency axis and n=1, . . . , N identifies a respective frequency bin on the Mel-frequency axis. MMS(n,d) indicates the modulation spectrum for a particular segment of the audio signal, whereas $\overline{MMS}(n,d)$ indicates the summarized modulation spectrum which characterizes the entire audio signal.

A second parameter for assisting tempo correction may be $MMS_{BEATSTRENGTH}$, which is the maximum value of the modulation spectrum according to equation 2. Typically, this value is high for electronic music and small for classical music.

$$MMS_{BEATSTRENGTH} = \max_{d}\left(\sum_{n=1}^{N} \overline{MMS}(n, d)\right) \tag{2}$$

A further parameter is $MMS_{CONFUSION}$, which is the mean of the modulation spectrum after normalization to 1 according to formula 3. If this latter parameter is low, then this is an indication for strong peaks on the modulation spectrum (e.g. like in FIG. 6). If this parameter is high, the modulation spectrum is widely spread with no significant peaks and there is a high degree of confusion.

$$MMS_{CONFUSION} = \frac{1}{N \cdot D} \sum_{n=1}^{N} \sum_{d=1}^{D} \left( \frac{\overline{MMS}(n, d)}{\max_{(n,d)}(\overline{MMS}(n, d))} \right) \tag{3}$$

Besides these parameters, i.e. the modulation spectral centroid or gravity $MMS_{Centroid}$, the modulation beat strength $MMS_{BEATSTRENGTH}$ and the modulation tempo confusion $MMS_{CONFUSION}$, other perceptually meaningful parameters may be derived which could be used for MIR applications.

It should be noted that the equations in this document have been formulated for Mel frequency Modulation Spectra, i.e. for modulation spectra 912, 913 determined from audio signals represented in the PCM domain and in the Transform domain. In the case where the modulation spectrum 911 determined from audio signals represented in the compressed domain is used, the terms $$MMS(n, d) \text{ and } \sum_{n=1}^{N} MMS(n, d)$$

need to be replaced by the term $MS_{SBR}(d)$ (Modulation Spectrum based on SBR payload data) in the equations provided in this document.

Based on a selection of the above parameters, a perceptual tempo correction scheme may be provided. This perceptual tempo correction scheme may be used to determine the perceptually most salient tempo humans would perceive from the physically most salient tempo obtained from the modulation representation. The method makes use of perceptually motivated parameters obtained from the modulation spectrum, namely a measure for musical speed given by the modulation spectrum centroid $MMS_{Centroid}$, the beat strength given by the maximum value in the modulation spectrum $MMS_{BEATSTRENGTH}$, and the modulation confusion factor $MMS_{CONFUSION}$ given by the mean of the modulation representation after normalization. The method may comprise any one of the following steps:

1. determining the underlying metric of the music track, e.g. 4/4 beat or 3/4 beat.
2. tempo folding to the range of interest according to the parameter $MMS_{BEATSTRENGTH}$
3. tempo correction according to perceptual speed measurement $MMS_{Centroid}$ Optionally, the determination of the modulation confusion factor $MMS_{CONFUSION}$ may provide a measure on the reliability of the perceptual tempo estimation.

Figure 11A:
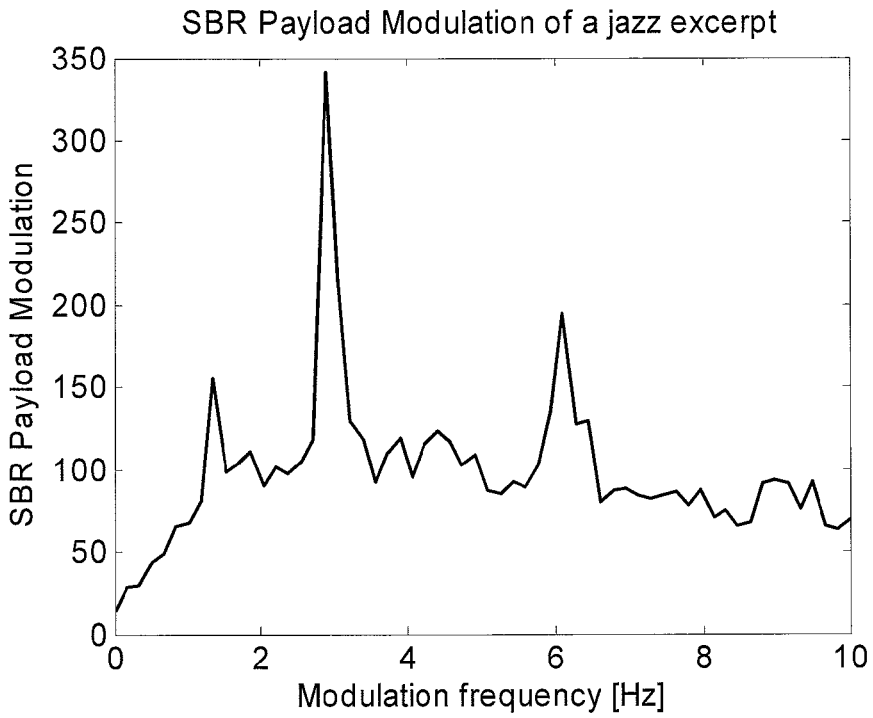
FIG. 11 shows exemplary modulation spectra for audio tracks having different metrics.
Figure 11B:
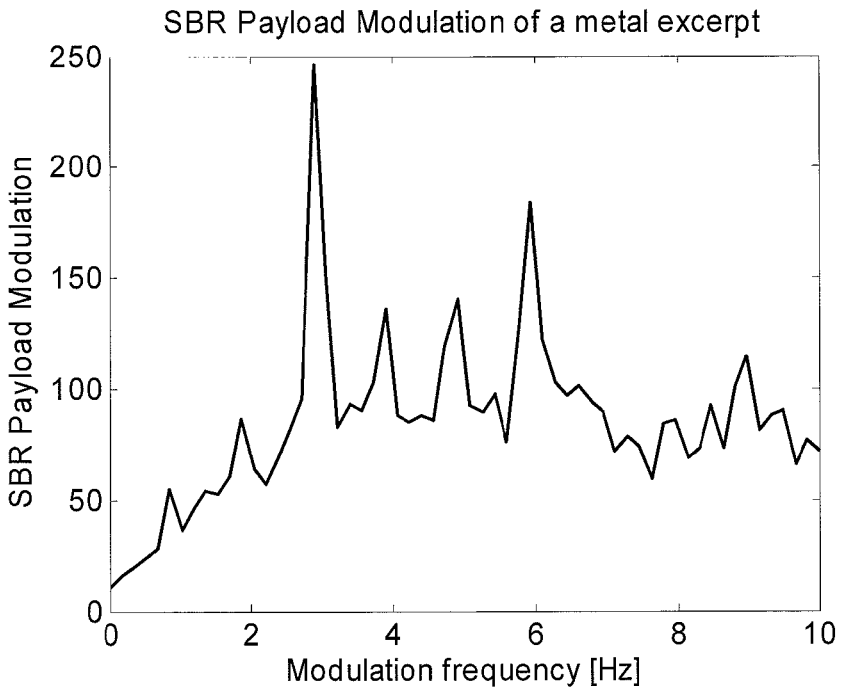

In a first step the underlying metric of a music track may be determined, in order to determine the possible factors by which the physically measured tempi should be corrected. By way of example, the peaks in the modulation spectrum of a music track with a 3/4 beat occur at three times the frequency of the base rhythm. Therefore, the tempo correction should be adjusted on a basis of three. In case of a music track with a 4/4 beat, the tempo correction should be adjusted by a factor of 2. This is shown in FIG. 11, where the SBR payload modulation spectrum of a jazz music track with 3/4 beat (FIG. 11*a*) and a metal music track at 4/4 beat (FIG. 11*b*) are shown. The tempo metric may be determined from the distribution of the peaks in the SBR payload modulation spectrum. In case of a 4/4 beat, the significant peaks are multiples of each other at a basis of two, whereas for 3/4 beat, the significant peaks are multiples at a basis of 3.

To overcome this potential source of tempo estimation errors, a cross correlation method may be applied. In an embodiment the autocorrelation of the modulation spectrum could be determined for different frequency lags Δd. The autocorrelation may be given by $$\mathrm{Corr}(\Delta d) = \frac{1}{DN} \sum_{d=1}^{D} \sum_{n=1}^{N} \overline{MMS}(n, d) \cdot \overline{MMS}(n, d + \Delta d) \tag{4}$$

Frequency lags Δd which yield maximum correlation Corr(Δd) provide an indication of the underlying metric. More precisely, if $d_{max}$ is the physically most salient modulation frequency, then the expression $$\frac{(d_{max} + \Delta d)}{d_{max}}$$

provides an indication of the underlying metric.

In an embodiment, the cross correlation between synthesized, perceptually modified multiples of the physically most salient tempo within the averaged modulation spectra may be used to determine the underlying metric. Sets of multiples for double (equation 5) and triple confusion (equation 6) are calculated as follows:

$$Multiples_{double} = d_{max} \cdot \left\{\frac{1}{4}, \frac{1}{2}, 1, 2, 4\right\} \tag{5}$$

$$Multiples_{triple} = d_{max} \cdot \left\{\frac{1}{6}, \frac{1}{3}, 1, 3, 6\right\} \tag{6}$$

In the next step, a synthesis of tapping functions at different metrics is performed, wherein the tapping functions are of equal length to the modulation spectrum representation, i.e. they are of equal length to the modulation frequency axis (equation 7):

$$SynthTab_{double,triple}(d) = \begin{cases} 1 & \text{if } d \in Multiples_{double,triple} \\ 0 & \text{otherwise,} \end{cases} \tag{7}$$

$$1 \le d \le D$$

The synthesized tapping functions $SynthTab_{double,triple}(d)$ represent a model of a person tapping at different metrical levels of the underlying tempo. I.e. assuming a 3/4 beat, the tempo may be tapped at 1/6 of its beat, at 1/3 of its beat, at its beat, at 3 times its beat and at 6 times its beat. In a similar manner, if a 4/4 beat is assumed, the tempo may be tapped at 1/4 of its beat, at 1/2 of its beat, at its beat, at twice its beat and at 4 times its beat.

If perceptually modified versions of the modulation spectra are considered, the synthesized tapping functions may need to be modified as well in order to provide a common representation. If perceptual blurring is neglected in the perceptual tempo extraction scheme, this step can be skipped. Otherwise, the synthesized tapping functions should undergo perceptual blurring as outlined by equation 8 in order to adapt the synthesized tapping functions to the shape of human tempo tapping histograms.

$$SynthTab_{double,triple}(d) = SynthTab_{double,triple}(d) * B, d \le 1 \le D \tag{8}$$

wherein B is a blurring kernel and * is a convolution operation. The blurring kernel B is a vector of fixed length which has the shape of a peak of a tapping histogram, e.g. the shape of a triangular or narrow Gaussian pulse. This shape of the blurring kernel B preferably reflects the shape of peaks of tapping histograms, e.g. 102, 103 of FIG. 1. The width of the blurring kernel B, i.e., the number of coefficients for the kernel B, and thus the modulation frequency range covered by the kernel B is typically the same across the complete modulation frequency range D. In an embodiment, the blurring kernel B is a narrow Gaussian like pulse with maximum amplitude of one. The blurring kernel B may cover a modulation frequency range of 0.265 Hz (−16 BPM), i.e. it may have a width of +−8 BPM from the center of the pulse.

Once the perceptual modification of the synthesized tapping functions has been performed (if required), a cross correlation at lag zero is calculated between the tapping functions and the original modulation spectrum. This is shown in equation 9:

$$Corr_{double,triple} = \sum_{d=1}^{D} \left( \sum_{n=1}^{N} \overline{MMS}(n, d) \right) \cdot SynthTab_{double,triple}(d), \tag{9}$$

Finally, a correction factor is determined by comparing the correlation results obtained from the synthesized tapping function for the "double" metric and the synthesized tapping function for the "triple" metric. The correction factor is set to 2 if its correlation obtained with the tapping function for double confusion is equal to or greater than the correlation obtained with the tapping function for triple confusion and vice versa (equation 10):

$$\text{Correction} = \begin{cases} 2 & \text{if } Corr_{double} >= Corr_{triple} \\ 3 & \text{else} \end{cases} \tag{10}$$

It should be noted that in generic terms, a correction factor is determined using correlation techniques on the modulation spectrum. The correction factor is associated with the underlying metric of the music signal, i.e. 4/4, 3/4 or other beats. The underlying beat metric may be determined by applying correlation techniques on the modulation spectrum of the music signal, some of which have been outlined above.

Using the correction factor the actual perceptual tempo correction may be performed. In an embodiment this is done in a stepwise manner. A pseudo-code of the exemplary embodiment is provided in Table 2.

TABLE 2

```
First step: Tempo correction according to beat strength and tempo
  if MMS_BEATSTRENGTH > treshhold and Tempo < 270
    keep Tempo
  else
    if Tempo > 145
        divide Tempo by Correction
        if Tempo > 220
            divide Tempo by Correction
        end
    elseif Tempo < 80
        multiply Tempo by Correction
    else
        keep Tempo
    end
Second step: consider the speed measure for tempo subjectivity
    if MMS_Centroid < AS (lower) and Tempo > 80
        divide Tempo by Correction
    elseif MMS_Centroid is in the range of AS and Tempo > 115
        divide Tempo by Correction
    elseif MMS_Centroid is in the range of AF and Tempo < 70
        multiply Tempo by Correction
    elseif MMS_Centroid > AF(upper) and Tempo < 110
        multiply Tempo by Correction
    else
        keep Tempo
    end
  end
```

In a first step the physically most salient tempo, referred to in Table 2 as "Tempo", is mapped into the range of interest by making use of the $MMS_{BEATSTRENGTH}$ parameter and the correction factor calculated previously. If the $MMS_{BEATSTRENGTH}$ parameter value is below a certain threshold (which is depending on the signal domain, audio codec, bit-rate and sampling frequency), and if the physically determined tempo, i.e. the parameter "Tempo", is relatively high or relatively low, the physically most salient tempo is corrected with the determined correction factor or beat metric.

Figure 12A:
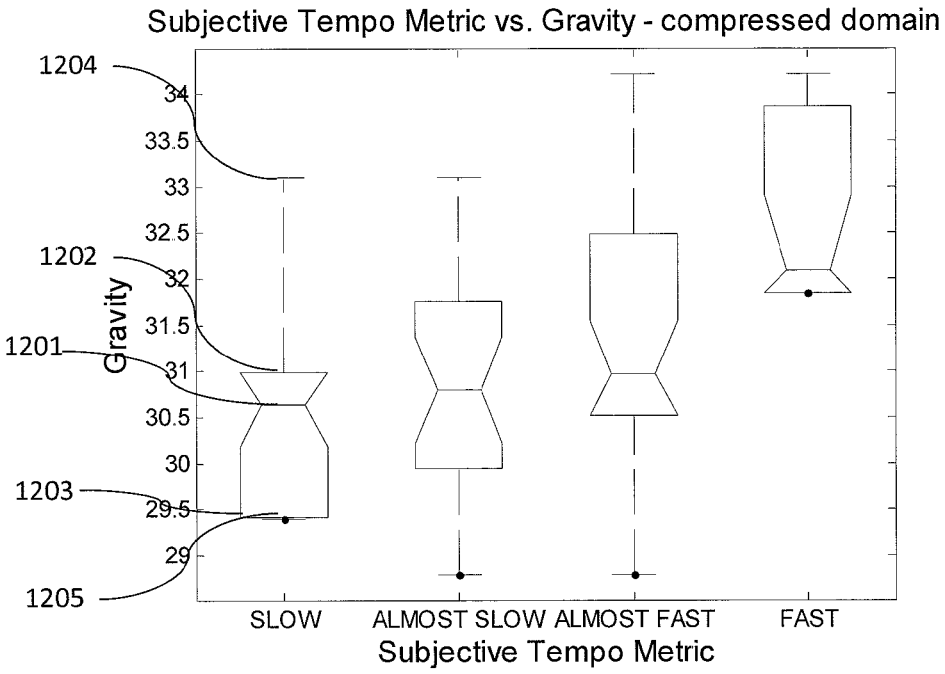
FIG. 12 shows exemplary experimental results for perceptual tempo classification.
Figure 12B:
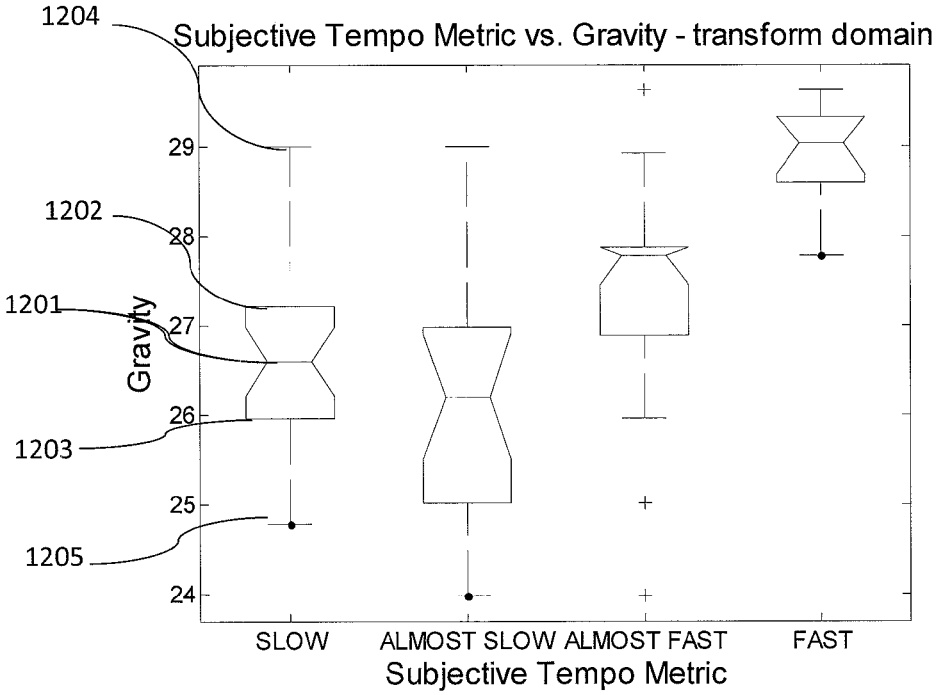
Figure 12C:
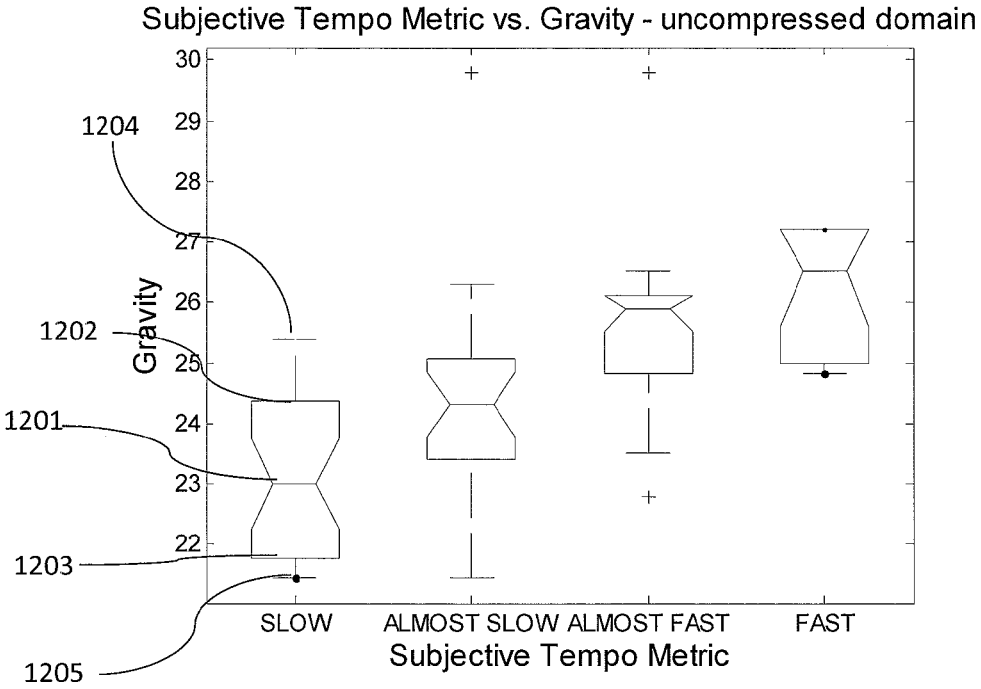

In a second step the tempo is corrected further according to the musical speed, i.e. according to the modulation spectrum centroid $MMS_{Centroid}$. Individual thresholds for the correction may be determined from perceptual experiments where users are asked to rank musical content of different genre and tempo, e.g. in four categories: Slow, Almost Slow, Almost Fast and Fast. In addition, the modulation spectrum centroids $MMS_{Centroid}$ are calculated for the same audio test items and mapped against the subjective categorization. The results of an exemplary ranking are shown in FIG. 12. The x-axis shows the four subjective categories Slow, Almost Slow, Almost Fast and Fast. The y-axis shows the calculated gravity, i.e. the modulation spectrum centroids. The experimental results using modulation spectra 911 on the compressed domain (FIG. 12*a*), using modulation spectra 912 on the transform domain (FIG. 12*b*) and using modulation spectra 913 on the PCM domain (FIG. 12*c*) are illustrated. For each category the mean 1201, the 50% confidence interval 1202, 1203 and the upper and lower quadrille 1204, 1205 of the rankings are shown. The high degree of overlap across the categories implies a high level of confusion with regards to the ranking of tempo in a subjective way. Nevertheless, it is possible to extract from such experimental results thresholds for the $MMS_{Centroid}$ parameter which allow an assignment of a music track to the subjective categories Slow, Almost Slow, Almost Fast and Fast. Exemplary threshold values for the $MMS_{Centroid}$ parameter for different signal representations (PCM domain, HE-AAC transform domain, compressed domain with SBR payload) are provided in Table 3.

TABLE 3

| Subjective metric | $MMS_{Centroid}$ (PCM) | $MMS_{Centroid}$ (HE-AAC) | $MMS_{Centroid}$ (SBR) |
|---|---|---|---|
| SLOW (S) | <23 | <26 | 30.5 |
| ALMOST SLOW (AS) | 23-24.5 | 26-27 | 30.5-30.9 |
| ALMOST FAST (AF) | 24.5-26 | 27-28 | 30.9-32 |
| FAST (F) | >26 | >28 | >32 |

These threshold values for the parameter $MMS_{Centroid}$ are used in a second tempo correction step outlined in Table 2. Within the second tempo correction step large discrepancies between the tempo estimate and the parameter $MMS_{Centroid}$ are identified and eventually corrected. By way of example, if the estimated tempo is relatively high and if the parameter $MMS_{Centroid}$ indicates that the perceived speed should be rather low, the estimated tempo is reduced by the correction factor. In a similar manner, if the estimated tempo is relatively low, whereas the parameter $MMS_{Centroid}$ indicates that the perceived speed should be rather high, the estimated tempo is increased by the correction factor.

TABLE 4

```
if (confusion < threshold)
    perceptual tempo = t1
else
    if t1 beyond preferred tempo (80-150 BPM) zone
        Fold t1 within preferred range: t2
        if slow & t2 > 80:                  perceptual tempo = t2/2
        if somewhat slow & t2 > 130:        perceptual tempo = t2/2
        if somewhat fast & t2 < 70:         perceptual tempo = t2 x 2
        if fast & t2 < 110:                 perceptual tempo = t2 x 2
    else perceptual tempo = t2
```

Another embodiment of a perceptual tempo correction scheme is outlined in Table 4. The pseudocode for a correction factor of 2 is shown, however, the example is equally applicable to other correction factors. In the perceptual tempo correction scheme of Table 4, it is verified in a first step if the confusion, i.e. $MMS_{CONFUSION}$ exceeds a certain threshold. If not, it is assumed that the physically salient tempo $t_1$ corresponds to the perceptually salient tempo. If, however, the level of confusion exceeds the threshold, then the physically salient tempo $t_1$ is corrected by taking into account information on the perceived speed of the music signal drawn from the parameter $MMS_{Centroid}$.

It should be noted that also alternative schemes could be used to classify the music tracks. By way of example, a classifier could be designed to classify the speed and then make these kinds of perceptual corrections. In an embodiment, the parameters used for tempo correction, i.e. notably $MMS_{CONFUSION}$, $MMS_{Centroid}$ and $MMS_{BEATSTRENGTH}$, could be trained and modelled to classify the confusion, the speed and the beat-strength of unknown music signals automatically. The classifiers could be used to perform similar perceptual corrections as outlined above. By doing this, the use of fixed thresholds as presented in Tables 3 and 4 can be alleviated and the system could be made more flexible.

As already mentioned above, the proposed confusion parameter $MMS_{CONFUSION}$ provides an indication on the reliability of the estimated tempo. The parameter could also be used as a MIR (Music Information Retrieval) feature for mood and genre classification.

It should be noted that the above perceptual tempo correction scheme may be applied on top of various physical tempo estimation methods. This is illustrated in FIG. 9, where is it shown that the perceptual tempo correction scheme may be applied to the physical tempo estimates obtained from the compressed domain (reference sign 921), it may be applied to the physical tempo estimates obtained from the transform domain (reference sign 922) and it may be applied to the physical tempo estimates obtained from the PCM domain (reference sign 923).

Figure 13:
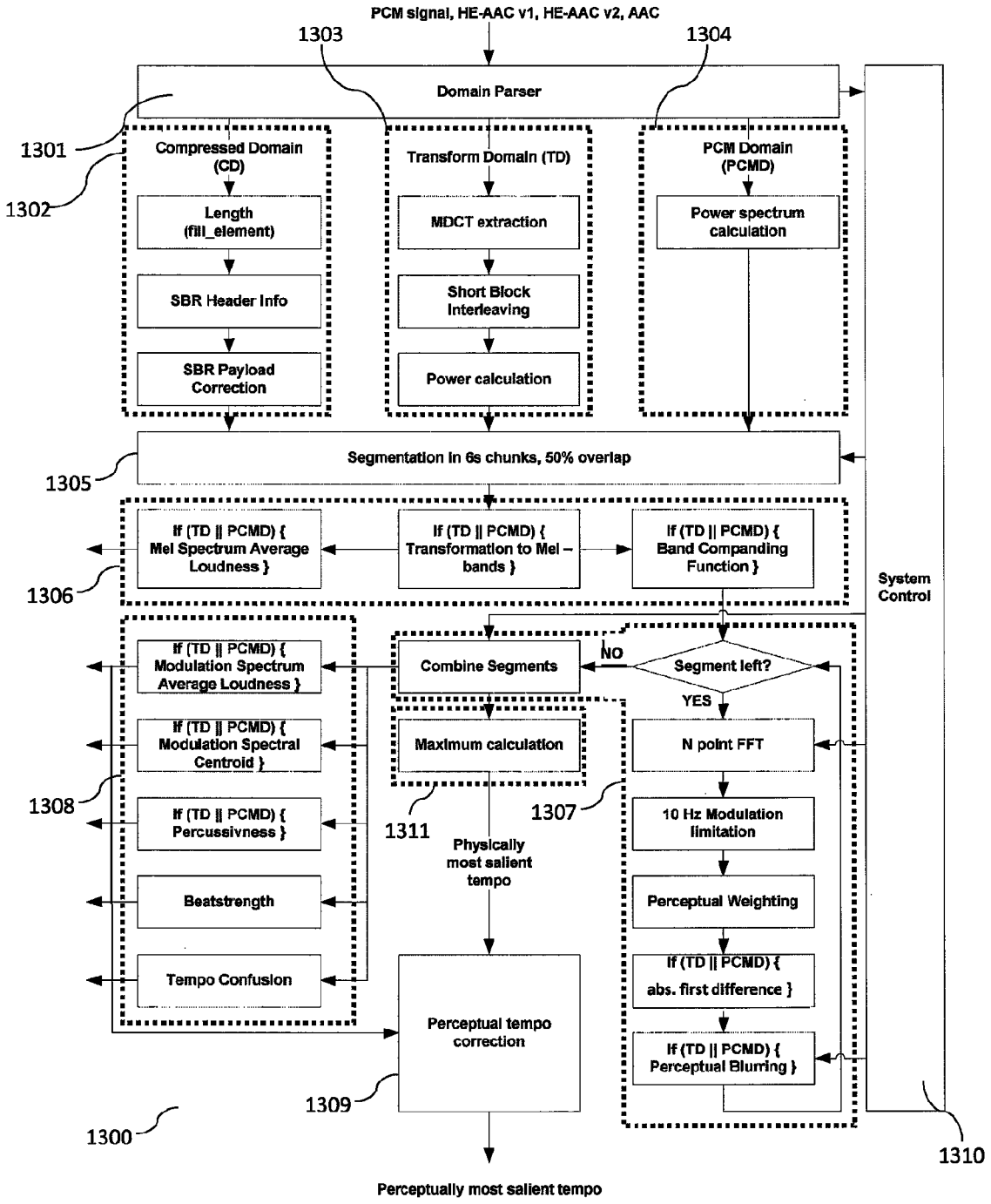
FIG. 13 shows an exemplary block diagram of a tempo estimation system.

An exemplary block diagram of a tempo estimation system 1300 is shown in FIG. 13. It should be noted that depending on the requirements, different components of such tempo estimation system 1300 can be used separately. The system 1300 comprises a system control unit 1310, a domain parser 1301, a pre-processing stage to obtain a unified signal representation 1302, 1303, 1304, 1305, 1306 1307, an algorithm to determine salient tempi 1311 and a post processing unit to correct extracted tempi in a perceptual way 1308, 1309.

The signal flow may be as follows. At the beginning, the input signal of any domain is fed to a domain parser 1301 which extracts all information necessary, e.g. the sampling rate and channel mode, for tempo determination and correction from the input audio file. These values are then stored in the system control unit 1310 which sets up the computational path according to the input-domain.

Extraction and pre-processing of the input-data is performed in the next step. In case of an input signal represented in the compressed domain such pre-processing 1302 comprises the extraction of the SBR payload, the extraction of the SBR header information and the header information error correction scheme. In the transform domain, the pre-processing 1303 comprises the extraction of MDCT coefficients, short block interleaving and power transformation of the sequence of MDCT coefficient blocks. In the uncompressed domain, the pre-processing 1304 comprises a power spectrogram calculation of the PCM samples. Subsequently, the transformed data is segmented into K blocks of half overlapping 6 second chunks in order to capture the long term characteristics of the input signal (Segmentation unit 1305). For this purpose control information stored in the system control unit 1310 may be used. The number of blocks K typically depends on the length of the input signal. In an embodiment, a block, e.g. the final block of an audio track, is padded with zeros if the block is shorter than 6 seconds.

Segments which comprise pre-processed MDCT or PCM data undergo a Mel-scale transformation and/or a dimension reduction processing step using a companding function (Mel-scale processing unit 1306). Segments comprising SBR payload data are directly fed to the next processing block 1307, the modulation spectrum determination unit, where an N point FFT is calculated along the time axis. This step leads to the desired modulation spectra. The number N of modulation frequency bins depends on the time resolution of the underlying domain and may be fed to the algorithm by the system control unit 1310. In an embodiment, the spectrum is limited to 10 Hz to stay within sensuous tempo ranges and the spectrum is perceptually weighted according to the human tempo preference curve 500.

In order to enhance the modulation peaks in the spectra based on the uncompressed and the transform domain, the absolute difference along the modulation frequency axis may be calculated in the next step (within the modulation spectrum determination unit 1307), followed by perceptual blurring along both the Mel-scale frequency and the modulation frequency axis to adapt the shape of tapping histograms. This computational step is optional for the uncompressed and transform domain since no new data is generated, but it typically leads to an improved visual representation of the modulation spectra.

Finally, the segments processed in unit 1307 may be combined by an averaging operation. As already outlined above, averaging may comprise the calculation of a mean value or the determination of a median value. This leads to the final representation of the perceptually motivated Mel-scale modulation spectrum (MMS) from uncompressed PCM data or transform domain MDCT data, or it leads to the final representation of the perceptually motivated SBR payload modulation spectrum ($MS_{SBR}$) of compressed domain bit-stream partials.

From the modulation spectra parameters such as Modulation Spectrum Centroid, Modulation Spectrum Beat strength and Modulation Spectrum Tempo Confusion can be calculated. Any of these parameters may be fed to and used by the perceptual tempo correction unit 1309, which corrects the physically most salient tempi obtained from maximum calculation 1311. The system's 1300 output is the Perceptually most salient tempo of the actual music input file.

It should be noted that the methods outlined for tempo estimation in the present document may be applied at an audio decoder, as well as at an audio encoder. The methods for tempo estimation from audio signals in the compressed domain, the transform domain, and the PCM domain may be applied while decoding an encoded file. The methods are equally applicable while encoding an audio signal. The complexity scalability notion of the described methods is valid when decoding and when encoding an audio signal.

It should also be noted that while the methods outlined in the present document may have been outlined in the context of tempo estimation and correction on complete audio signals, the methods may also be applied to sub-sections, e.g. the MMS segments, of the audio signal, thereby providing tempo information for the sub-sections of the audio signal.

As a further aspect, it should be noted that the physical tempo and/or perceptual tempo information of an audio signal may be written into the encoded bit-stream in the form of metadata. Such metadata may be extracted and used by a media player or by a MIR application.

Furthermore, it is contemplated to modify and compress modulation spectral representations (e.g. the modulation spectra 1001, and in particular 1002 and 1003 of FIG. 10.), and to store the possibly modified and/or compressed modulation spectra as metadata within an audio/video file or bit-stream. This information could be used as acoustic image thumbnails of the audio signal. This maybe useful to provide a user with details with regards to the rhythmic content in the audio signal.

In the present document, a complexity scalable modulation frequency method and system for reliable estimation of physical and perceptual tempo has been described. The estimation may be performed on audio signals in the uncompressed PCM domain, the MDCT based HE-AAC transform domain and the HE-AAC SBR payload based compressed domain. This allows the determination of tempo estimates at very low complexity, even when the audio signal is in the compressed domain. Using the SBR payload data, tempo estimates may be extracted directly from the compressed HE-AAC bit-stream without performing entropy decoding. The proposed method is robust against bit-rate and SBR cross-over frequency changes and can be applied to mono and multi-channel encoded audio signals. It can also be applied to other SBR enhanced audio coders, such as mp3PRO and can be regarded as being codec agnostic. For the purpose of tempo estimating it is not required that the device performing the tempo estimation is capable of decoding the SBR data. This is due to the fact that the tempo extraction is directly performed on the encoded SBR data.

In addition, the proposed methods and system make use of knowledge on human tempo perception and music tempo distributions in large music datasets. Besides an evaluation of a suitable representation of the audio signal for tempo estimation, a perceptual tempo weighting function as well as a perceptual tempo correction scheme is described. Furthermore, a perceptual tempo correction scheme is described which provides reliable estimates of the perceptually salient tempo of audio signals.

The proposed methods and systems may be used in the context of MIR applications, e.g. for genre classification. Due to the low computational complexity, the tempo estimation schemes, in particular the estimation method based on SBR payload, may be directly implemented on portable electronic devices, which typically have limited processing and memory resources.

Furthermore, the determination of perceptually salient tempi may be used for music selection, comparison, mixing and playlisting. By way of example, when generating a playlist with smooth rhythmic transitions between adjacent music tracks, information regarding the perceptually salient tempo of the music tracks may be more appropriate than information regarding the physical salient tempo.

The tempo estimation methods and systems described in the present document may be implemented as software, firmware and/or hardware. Certain components may e.g. be implemented as software running on a digital signal processor or microprocessor. Other components may e.g. be implemented as hardware and or as application specific integrated circuits. The signals encountered in the described methods and systems may be stored on media such as random access memory or optical storage media. They may be transferred via networks, such as radio networks, satellite networks, wireless networks or wireline networks, e.g. the internet. Typical devices making use of the methods and systems described in the present document are portable electronic devices or other consumer equipment which are used to store and/or render audio signals. The methods and system may also be used on computer systems, e.g. internet web servers, which store and provide audio signals, e.g. music signals, for download.

What is claimed is:

1. A method for extracting tempo information of an audio signal, the method comprising:

providing a compressed, spectral band replication (SBR) encoded bitstream of the audio signal, wherein the encoded bitstream comprises spectral band replication data;

determining an amount of data comprised in one or more fill-element fields of the encoded bit-stream for a time-interval of the audio signal;

determining a size of SBR payload data comprised in the encoded bit-stream for the time interval of the audio signal based on the amount of data comprised in the one or more fill-element fields of the encoded bit-stream for the time-interval of the audio signal;

repeating the determining steps for successive time intervals of the encoded bit-stream of the audio signal, thereby determining a sequence of sizes of SBR payload data;

identifying a periodicity in the sequence of sizes of SBR payload data; and extracting tempo information of the audio signal from the identified periodicity, wherein the method is implemented by an audio signal processing device comprising one or more hardware elements.

2. The method of claim 1, wherein determining a size of SBR payload data comprises:

determining the amount of spectral band replication header data comprised in the one or more fill-element fields of the encoded bit-stream in the time interval;

determining a net amount of data comprised in the one or more fill-element fields of the encoded bit-stream in the time interval by deducting the amount of spectral band replication header data comprised in the one or more fill-element fields of the encoded bit-stream in the time interval; and determining the size of SBR payload data based on the net amount of data.

3. The method of claim 1, wherein the encoded bit-stream comprises a plurality of frames, each frame corresponding to an excerpt of the audio signal of a pre-determined length of time; and the time interval corresponds to a frame of the encoded bit-stream.

4. The method claim 1, wherein identifying a periodicity comprises:

identifying a periodicity of peaks in the sequence of sizes of SBR payload data.

5. The method of claim 1, wherein identifying a periodicity comprises:

performing spectral analysis on the sequence of sizes of SBR payload data yielding a set of power values and corresponding frequencies; and identifying a periodicity in the sequence of sizes of SBR payload data by determining a relative maximum in the set of power values and by selecting the periodicity as the corresponding frequency.

6. The method of claim 5, wherein performing spectral analysis comprises:

performing spectral analysis on a plurality of sub-sequences of the sequence of sizes of SBR payload data yielding a plurality of sets of power values; and averaging the plurality of sets of power values.

7. A non-transitory storage medium comprising a software program adapted for execution by a processor of an audio signal processing device comprising one or more hardware elements, wherein, when executed by the processor of the audio signal processing device, the program causes the audio signal processing device to perform the method steps of claim 1.

8. An audio signal processing device configured to extract tempo information of an audio signal, wherein the audio signal processing device is configured to:

provide a compressed, spectral band replication (SBR) encoded bitstream of the audio signal, wherein the encoded bitstream comprises spectral band replication data;

determine an amount of data comprised in one or more fill-element fields of the encoded bit-stream for a time-interval of the audio signal;

determine a size of SBR payload data comprised in the encoded bit-stream for the time interval of the audio signal based on the amount of data comprised in the one or more fill-element fields of the encoded bit-stream for the time-interval of the audio signal;

repeat the determining steps for successive time intervals of the encoded bit-stream of the audio signal, thereby determining a sequence of sizes of SBR payload data;

identify a periodicity in the sequence of sizes of SBR payload data; and extract tempo information of the audio signal from the identified periodicity, wherein the audio signal processing device comprises one or more hardware elements.

* * * * *